US005352567A

United States Patent [19]

Okada et al.

[11] Patent Number: 5,352,567

[45] Date of Patent: Oct. 4, 1994

[54] METHOD FOR PROCESSING SILVER HALIDE COLOR PHOTOGRAPHIC MATERIAL USING COMPOSITION HAVING A BLEACHING ABILITY

[75] Inventors: Hisashi Okada; Tadashi Inaba; Morio Yagihara, all of Kanagawa, Japan

[73] Assignee: Fuji Photo Film Co., Ltd., Kanagawa, Japan

[21] Appl. No.: 948,318

[22] Filed: Sep. 22, 1992

Related U.S. Application Data

[63] Continuation-in-part of Ser. No. 643,621, Jan. 22, 1991, abandoned.

[30] Foreign Application Priority Data

Jan. 22, 1990 [JP] Japan ..... 2-12332

[51] Int. Cl.[5] ..... G03C 7/42

[52] U.S. Cl. ..... 430/393; 430/430; 430/460; 430/461

[58] Field of Search ..... 430/393, 430, 460, 461

[56] References Cited

U.S. PATENT DOCUMENTS

| | | | |
|---|---|---|---|
| 4,804,618 | 2/1989 | Ueda et al. | 430/393 |
| 4,939,073 | 7/1990 | Koboshi et al. | 430/372 |
| 5,002,859 | 3/1991 | Kuse et al. | 430/393 |
| 5,063,140 | 11/1991 | Kuse et al. | 430/393 |
| 5,188,927 | 2/1993 | Okada et al. | 430/393 |

FOREIGN PATENT DOCUMENTS

| | | |
|---|---|---|
| 63-97952 | 4/1988 | Japan . |
| 63-97953 | 4/1988 | Japan . |
| 329088 | 8/1989 | Japan . |

*Primary Examiner*—Hoa Van Le
*Attorney, Agent, or Firm*—Sughrue, Mion, Zinn, Macpeak & Seas

[57] ABSTRACT

A novel method for processing a silver halide color photographic material which comprises color developing an imagewise exposed silver halide color photographic material and then processing the material with a having a bleaching ability containing at least one bleaching agent a ferric complex of a compound represented by at least one of formula (I) and formula (II):

(I)

wherein $W^1$ represents an alkylene group containing 3 or less carbon atoms in total; $L^1$, $L^2$, $L^3$ and $L^4$ each represents an alkylene or arylene group; and $M_1$ to $M_6$ each represents a hydrogen atom or a cation;

(II)

wherein $W^2$ represents an alkylene group having 2 to 8 carbon atoms, an arylene group having 6 to 10 carbon atoms, cyclohexane group, (in which $W^{21}$ and $W^{22}$ each represents an alkylene group, and m represents an integer of 1 to 3, and A represents a hydrogen atom, hydrocarbon group, $—L_A—COOM$, $—L_A—PO_3M_2$, $—L_A—OH$ or $—L_A—SO_3M$ ($L_A$ represents an alkylene group having 1 to 8 carbon atoms or an arylene group having 6 to 10 carbon atoms, and M represents a hydrogen atom or a cation such as an alkali metal or ammonium)), or a combination of theseof; $L^5$, $L^6$, $L^7$ and $L^8$ each represents an alkylene group; and $M_7$, $M_8$, $M_9$, $M_{10}$ and $M_{11}$ each represents a hydrogen atom or a cation.

8 Claims, No Drawings

METHOD FOR PROCESSING SILVER HALIDE COLOR PHOTOGRAPHIC MATERIAL USING COMPOSITION HAVING A BLEACHING ABILITY

This is a Continuation-in-Part of application Ser. No. 07/643,621 filed Jan. 22, 1991, now abandoned.

FIELD OF THE INVENTION

The present invention relates to a method for processing silver halide color photographic material using a composition having a bleaching ability. More particularly, the present invention relates to a method capable of rapid desilvering as well as processing with no bleaching fog and little stain during the subsequent storage of images.

BACKGROUND OF THE INVENTION

In general, the method for processing a silver halide color photographic material (hereinafter referred to as "color light-sensitive material") basically comprises a color development step and a desilvering step. In the color development step, silver halide which has been exposed to light is reduced by an aromatic primary amine color developing agent to produce silver while an oxidation product of the color developing agent reacts with a coupler to form dye images. In the subsequent desilvering step, silver which has been produced at the color development step is oxidized and then becomes soluble by a silver ion complexing agent commonly called fixing agent. After this desilvering step, only dye images remain on the color light-sensitive material.

The above mentioned desilvering step can be effected in a two-bath system comprising a bleaching bath containing a bleaching agent and a fixing bath containing a fixing agent, in a blixing bath containing both a bleaching agent and a fixing agent or in a system comprising a combination thereof. These baths each may consist of a plurality of processing tanks.

The actual development process comprises auxiliary processing steps other than the above mentioned basic steps in order to preserve the photographic and physical qualities of images or improve the preservability of images. Examples of such auxiliary baths include film hardening bath, stopping bath, image stabilizing bath, and washing bath.

In recent years, it has been keenly desired to reduce the time required for the above mentioned processing in order to rapidly meet customers' demand for processing as small-sized over-the-counter process service system commonly called mini-laboratory has spreaded. It has been most keenly desired to reduce the time required for desilvering step, which has accounted for the majority of the processing time. In particular, it has been required to expedite bleaching step.

It has been well known that an oxidizing agent (bleaching agent) having a strong oxidative effect can be used to reduce the bleaching time. Examples of such a bleaching agent include inorganic compounds such as red prussiate, ferric chloride, persulfate, and dichromate, and metallic chelelating compounds such as ferric complex of aminopolycarboxylic acid. In recent years, in the light of atmospheric preservation and safety in handling, ferric chelates of aminopolycarboxylic acid having a strong oxidative effect have been developed. Examples of such ferric chelates of aminopolycarboxylic acid which have been developed include ferric complexes of 1,3-propanediaminetetraacetate (e.g., 1,3-PDTA-Fe(III)), and ferric complexes of glycoletherdiaminetetraacetate (e.g., GEDTA-Fe(III)).

However, it has been known that when the color development step using an aromatic primary amine color developing agent is followed by a processing step in a bleaching bath or blixing bath containing such a strong oxidizing agent, a great disadvantage takes place that the color developing agent which has been carried over with the film is oxidized and then reacts with a coupler to cause a remarkable color stain called bleaching fog (see James, *The Theory of Photographic Process*) which prevents the expedition of bleaching.

In order to avoid disadvantage, the color development step can be followed by a stopping or rinsing step where the developing agent is removed from the film which is then subjected to bleaching or blixing. However, this approach is disadvantageous in that the increase in the number of processing baths makes it impossible to accomplish the original object, i.e., reduction in the processing time.

Furthermore, it has been made clear that the short time processing in such a bleaching or blixing bath causes another trouble, i.e., drastic increase in stain during the storage of processed color light-sensitive materials.

As an approach for solving such bleaching fog or increase in stain, a processing method is disclosed in JP-A-1-213657 (the term "JP-A" as used herein means an "unexamined published Japanese patent application") which comprises the reduction of the pH value of the bleaching solution to 2.5 to 4.2. A similar embodiment is C-41RA, which is a commonly used color negative film processing agent (bleaching solution with a pH value of 4.3 containing acetic acid) published by Eastman Codak in 1988. These approaches leave to be desired in the solution of the above mentioned disadvantages. It has also been made clear that these approaches are disadvantageous in that the evaporation of acetic acid used for the reduction in pH deteriorates the atmosphere or causes corrosion or deterioration of peripheral equipment and apparatus.

SUMMARY OF THE INVENTION

It is therefore an object of the present invention to provide an odorless processing solution having a bleaching ability which causes no contamination in the working atmosphere.

It is another object of the present invention to provide a processing solution having a bleaching and desilvering ability which causes no bleaching fog and little stain after processing and a processing method using such a processing solution.

It is a further object of the present invention to provide such a processing solution having an excellent rapid desilvering ability and a processing method using such a processing solution.

The above and other objects of the present invention will become more apparent from the following detailed description and examples.

These objects of the present invention are accomplished with a method for processing a silver halide color photographic material comprising color developing an imagewise exposed silver halide color photographic material and then processing the material with a processing solution having a bleaching ability containing at least one bleaching agent; wherein said bleaching agent is a ferric complex of a compound represented by at least one of formula (I) and formula

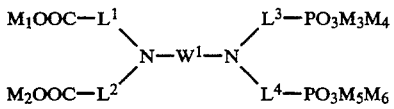

(I)

wherein $W^1$ represents an alkylene group containing 3 or less carbon atoms in total; $L^1$, $L^2$, $L^3$ and $L^4$ each represents an alkylene or arylene group; and $M_1$ to $M_6$ each represents a hydrogen atom or a cation;

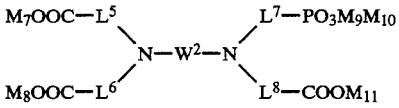

(II)

wherein $W^2$ represents an alkylene group having 2 to 8 carbon atoms, an arylene group having 6 to 10 carbon atoms, cyclohexane group,

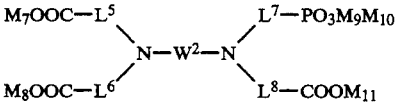

(II)

(in which $W^{21}$ and $W^{22}$ each represents an alkylene group, and m represents an integer of 1 to 3, and A represents a hydrogen atom, hydrocarbon group, $—L_A—COOM$, $—L_A—PO_3M_2$, $—L_A—OH$ or $—L_A—SO_3M$ ($L_A$ represents an alkylene group having 1 to 8 carbon atoms or an arylene group having 6 to 10 carbon atoms, and M represents a hydrogen atom or a cation such as an alkali metal or ammonium)), or a combination of theseof; $L^5$, $L^6$, $L^7$ and $L^8$ each represents an alkylene group; and $M_7$, $M_8$, $M_9$, $M_{10}$ and $M_{11}$ each represents a hydrogen atom or a cation.

DETAILED DESCRIPTION OF THE INVENTION

The compounds represented by formulae (I) and (II) will be further described hereinafter.

$W^1$ represents an alkylene group containing 3 or less carbon atoms in total. This alkylene group may contain substituents. This means that the alkylene group contains 3 or less carbon atoms even if it contains substituents. Examples of such substituents include alkyl group, aralkyl group, alkenyl group, alkynyl group, alkoxy group, amino group, acylamino group, sulfonylamino group, ureide group, urethane group, sulfamoyl group, carbamoyl group, alkylthio group, sulfonyl group, sulfinyl group, hydroxyl group, halogen atom, cyano group, sulfo group, carboxyl group, phosphono group, acyl group, alkoxycarbonyl group, acyloxycarbonyl group, acyloxy group, carbonamide group, sulfonamide group, and nitro group.

Preferred examples of such substituents include alkyl group (more preferably methyl group), alkoxy group (more preferably methoxy group), amino group (more preferably amino group, methylamino group), sulfonylamino group (more preferably methanesulfonylamino group), sulfamoyl group (more preferably sulfamoyl group, methylsulfamoyl group), carbamoyl group (more preferably carbamoyl group), alkylthio group (more preferably methylthio group), hydroxyl group, halogen atom, cyano group, sulfo group, carboxyl group, phosphono group, and nitro group.

Preferred alkylene groups for $W^1$ include

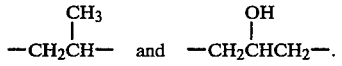

$W^2$ represents an alkylene group having 2 to 8 carbon atoms, an arylene group having 6 to 10 carbon atoms, cyclohexane group, $-(W^{21}—O)_m—W^{22}—$, $-(W^{21}—S)_m—W^{22}—$ (in which $W^{21}$ and $W^{22}$ each represents an alkylene group, and m represents an integer 1 to 3),

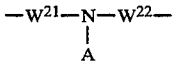

(in which A represents a hydrogen atom, hydrocarbon group, $—L_A—COOM$, $—L_A—PO_3M_2$, $—L_A—OH$ or $—L_A—SO_3M$ ($L_A$ represents an alkylene group having 1 to 8 carbon atoms or an arylene group having 6 to 10 carbon atoms), and M represents a hydrogen atom or a cation such as an alkali metal or ammonium)), or a combination of theseof. The alkylene group, arylene group and cyclohexane group may contain substituents. Examples of such substituents include alkyl group, aralkyl group, alkenyl group, alkynyl group, alkoxy group, aryl group, substituted amino group, acylamino group, sulfonylamino group, ureide group, urethane group, aryloxy group, sulfamoyl group, carbamoyl group, alkylthio group, arylthio group, sulfonyl group, sulfinyl group, hydroxyl group, halogen atom, cyano group, sulfo group, carboxyl group, phosphono group, aryloxycarbonyl group, acyl group, alkoxycarbonyl group, acyloxy group, carbonamide group, sulfonamide group, and nitro group.

Preferred $W^2$ include

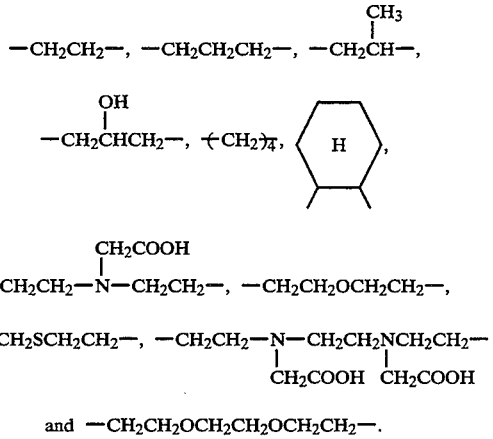

$L^1$ to $L^4$ each represents an alkylene group (preferably having 1 to 6 carbon atoms) or arylene group (preferably having 6 to 10 carbon atoms (e.g., more preferably a phenylene group)), preferably an alkylene group and more preferably a methylene group or an ethylene group. Most preferably, in the formula (I), at least one of $L^1$ to $L^4$ is an ethylene group.

$L^4$ to $L^8$ each represents an alkylene group (preferably having 1 to 6 carbon atoms), preferably a methylene group or ethylene group.

$M_1$ to $M_{11}$ each represents a hydrogen atom or a cation. Examples of such a cation include alkali metal (e.g., lithium, sodium, potassium), ammonium, and pyridinium. Among these, lithium, sodium, potassium, ammonium, tetramethylammonium, tetraethylammonium and pyridium are preferred.

Preferred among compounds represented by formula (I) or (II) are those represented by formula (II).

Specific examples of compounds represented by formula (I) or (II) are set forth below, but the present invention should not be construed as being limited thereto.

1.
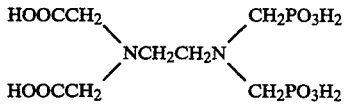

2.
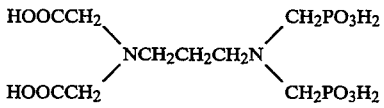

3.
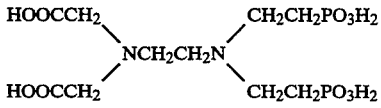

4.
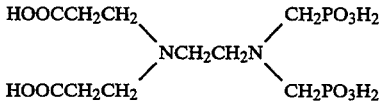

5.
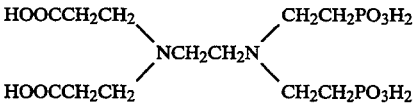

6.
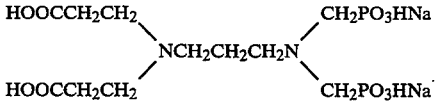

7.
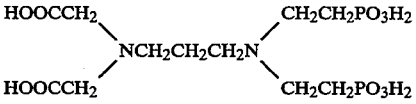

8.
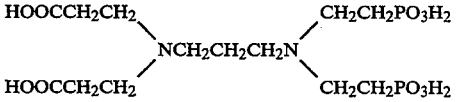

9.
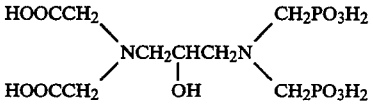

10.
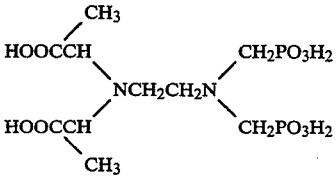

11.
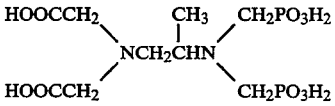

12.
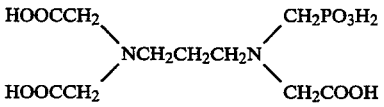

13.
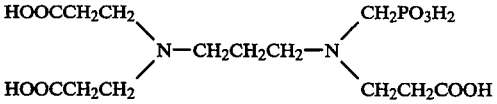

14.
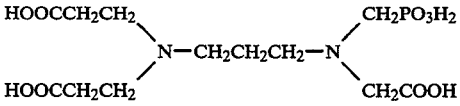

15.
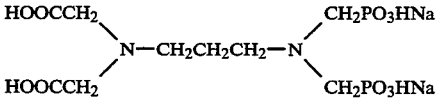

16.
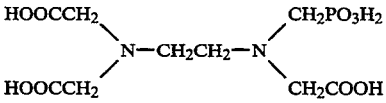

17.
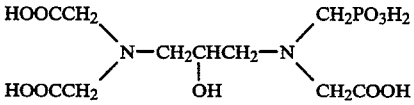

18.
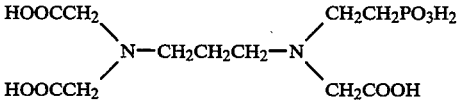

19.
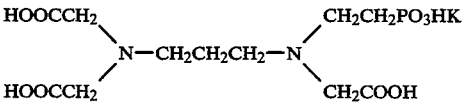

20.
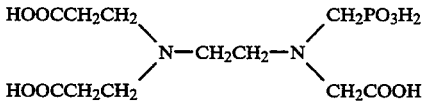

21.
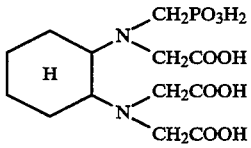

22.
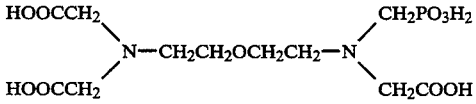

23.
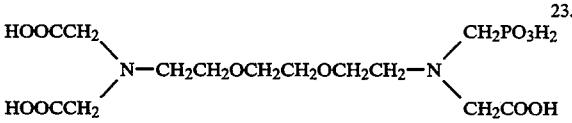

24.
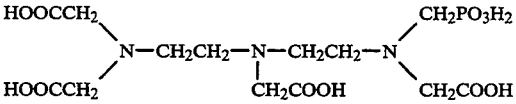

-continued

25.

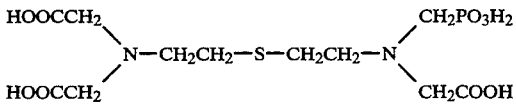

26.

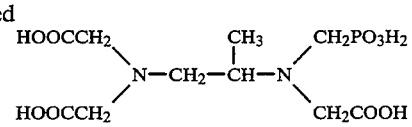

27.

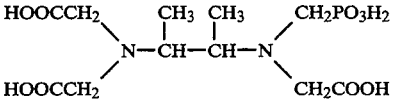

28.

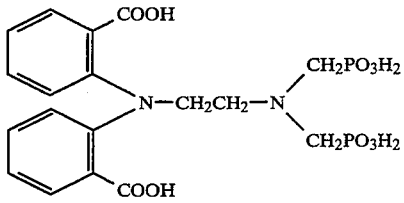

29.

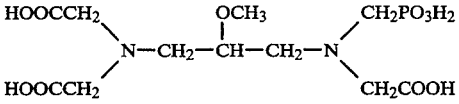

30.

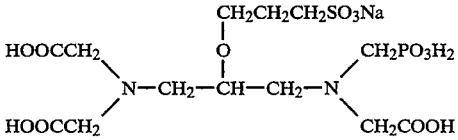

31.

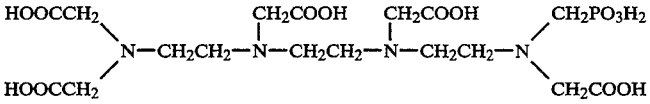

32.

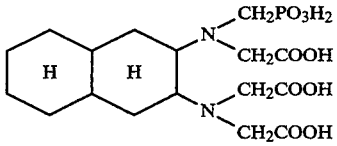

33.

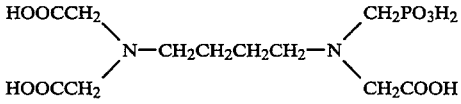

34.

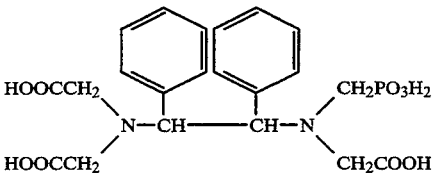

35.

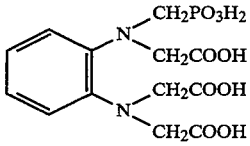

The synthesis of the compound represented by formula (I) can be accomplished in accordance with the method described in Zhurnal Obshcei Khimii, vol. 46, page 501 (1976), and vol. 47, page 2596 (1977). Specific examples of synthesis of typical compounds are set forth below.

SYNTHESIS EXAMPLE 1: Synthesis of Compound 1

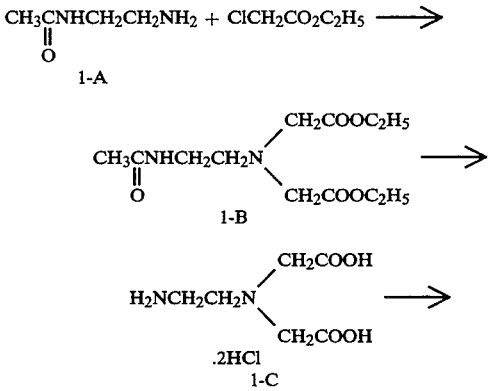

-continued

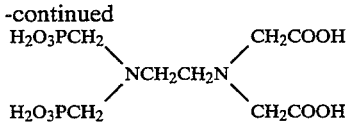

1

1-(1): Synthesis of Compound 1-B 102 g (1.0 mol) of N-acetylethylenediamine (1-A) was dissolved in 500 ml of acetonitrile. 304 g (2.2 mol) of potassium carbonate was then added to the solution. 270 g (2.2 mol) of ethyl chloroacetate was added dropwise to the reaction mixture at room temperature with stirring. The reaction mixture was then heated under reflux for 2 hours. The reaction system was then allowed to cool to room temperature. The resulting solid material was filtered off, and the filtrate was then concentrated under reduced pressure. The material was then purified through a silica gel column chromatography (developing solvent: dichloromethane/ethyl acetate=4/1 (by volume)) to obtain 132 g (0.48 mol) of an oily material 1-B. (Yield: 48%)

1-(2): Synthesis of Compound 1-C 132 g (0.48 mol) of Compound 1-B obtained in 1-(1) was dissolved in 400 g of water. 77.0 g (1.93 mol) of sodium hydroxide was then added to the solution. The reaction mixture was heated under reflux for 1 hour. The reaction system was allowed to cool to room temperature. 300 ml (3.5 mol) of concentrated hydrochloric acid was added to the reaction system. The resulting sodium chloride was removed by filtration, and the filtrate was then concentrated to 300 ml under reduced pressure. 300 ml of ethanol was added to the material. The resulting crystal was filtered off, and then recrystallized from a mixture of water and ethanol to obtain 94.7 g (0.38 mol) of Compound 1-C. (Yield: 79%)

1-(3): Synthesis of Compound 1

94.7 g (0.38 mol) of Compound 1-C obtained in 1-(2) was dissolved in 500 ml of water. 100 ml (1.2 mol) of concentrated hydrochloric acid and 68.6 g (0.84 mol) of phosphorous acid were then added to the solution. The reaction mixture was heated under reflux. 77 g (0.95 mol) of a 37% aqueous solution of formalin was gradually added dropwise to the reaction system under reflux. After the dropwise addition was completed, the reaction system was further heated under reflux for 3 hours. The reaction system was then allowed to cool to room temperature. 500 ml of ethanol was added to the reaction system. The resulting white pasty material was recrystallized from a mixture of water and methanol to obtain 56.7 g (0.16 mol) of a white solid material. (Yield: 42%)

SYNTHESIS EXAMPLE 2: Synthesis of Compound 12

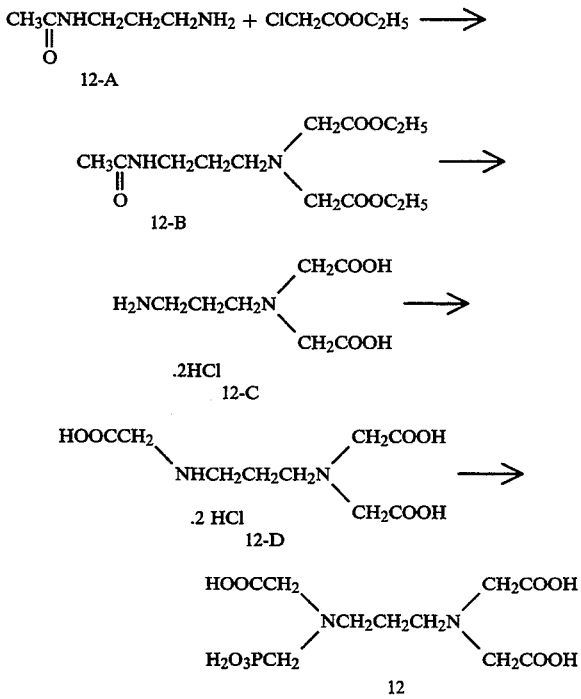

2-(1): Synthesis of Compound 12-B 158 g (0.55 mol) of an oily material 12-B was prepared from 116 g (1.0 mol) of N-acetyl-1,3-propanediamine 12-A, 304 g (2.2 mol) of potassium carbonate and 270 g of ethyl chloroacetate in the same manner as in 1-(1). (Yield: 55%)

2-(2): Synthesis of Compound 12-C 126 g (0.48 mol) of Compound 12-C was prepared from 158 g (0.55 mol) of Compound 12-B obtained in 2-(1) and 88.0 g (2.20 mol) of sodium hydroxide in the same manner as in 1-(2). (Yield: 87%)

2-(3): Synthesis of Compound 12-D 126 g (0.48 mol) of Compound 12-C obtained in 2-(2) was dissolved in 400 ml of water. 80 g (2.0 mol) of sodium hydroxide was added to the solution. A solution of 48.6 g (0.53 mol) of glyoxylic monohydrate in 150 ml of water was then added dropwise to the reaction mixture with stirring while being cooled with ice. 2 g of 10 wt % Pd-C was added to the reaction solution. The reaction system was then hydrogenated ($H_2$: 100 psi) at room temperature. The catalyst was removed from the reaction system. Water was distilled off. 200 ml of concentrated hydrochloric acid was added to the reaction system. Ethanol was then added to the reaction system. The resulting white solid material was recrystallized from a mixture of water and ethanol to obtain 102 g (0.32 mol) of Compound 12-D. (Yield: 67%)

2-(4): Synthesis of Compound 12

61.6 g (0.18 mol) of a white solid material was prepared from 102 g (0.32 mol) of Compound 12-D obtained in 1-(3), 84 ml (0.98 mol) of concentrated hydrochloric acid, 57.8 g (0.71 mol) of phosphorous acid, and 64.8 g (0.80 mol) of a 37 wt % aqueous solution of formalin in the same manner as in 1-(3). (Yield: 56%)

SYNTHESIS EXAMPLE 3: Synthesis of Compound 20

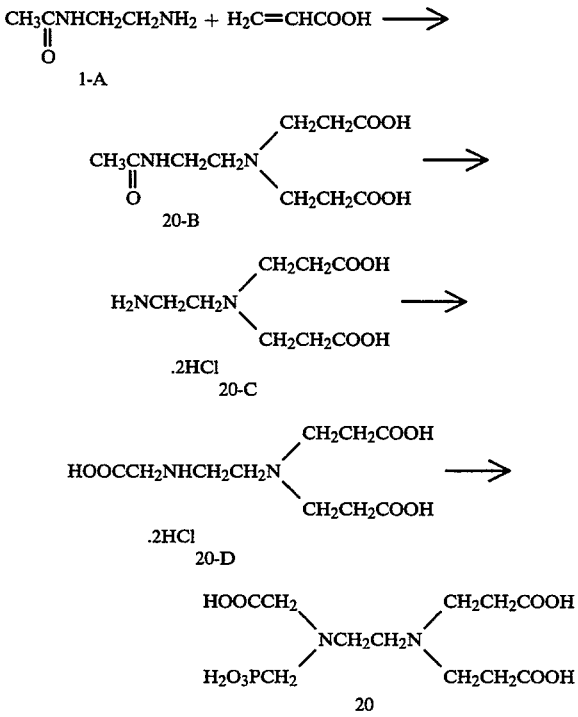

3-(1): Synthesis of Compound 20-B 102 g (1.0 mol) of N-acetylethylenediamine (1-A) was dissolved in 200 ml of water. 151 g (2.1 mol) of acrylic acid was gradually added dropwise to the solution at room temperature. The reaction mixture was heated under reflux for 2 hours. The reaction solution was concentrated. Ether was then added to the material. The resulting white solid material was filtered off, and then recrystallized from a mixture of methanol and ether to obtain 154 g (0.63 mol) of Compound 20-B. (Yield: 63%)

3-(2): Synthesis of Compound 20-C 141 g (0.51 mol) of Compound 20-C was prepared from 154 g (0.63 mol) of Compound 20-B obtained in 3-(1) and 50 g (1.25 mol) of sodium hydroxide in the same manner as in 1-(2). (Yield: 81%)

3-(3): Synthesis of Compound 20-D 99.0 g (0.30 mol) of Compound 20-D was prepared from 141 g (0.51 mol) of Compound 20-C obtained in 3-(2), 85 g (2.1 mol) of sodium hydroxide and 51.6 g (0.56 mol) of glyoxylic monohydrate in the same manner as in 2-(3). (Yield: 59%)

3-(4): Synthesis of Compound 20

52.3 g (0.15 mol) of Compound 20 was prepared from 99 g (0.30 mol) of Compound 20-D obtained in 3-(3), 80 ml (0.93 mol) of concentrated hydrochloric acid and 60.8 g (0.75 mol) of a 37% aqueous solution of formalin in the same manner as in 1-(3). (Yield: 50%)

SYNTHESIS EXAMPLE 4: Synthesis of Compound 2

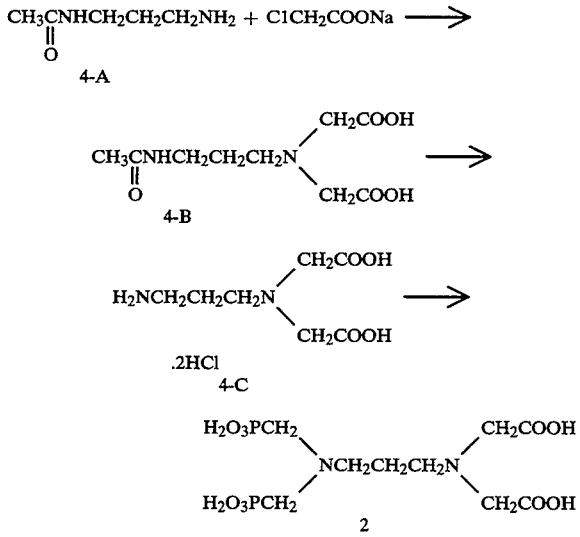

4-(1): Synthesis of Compound 4-B 53.7 g (0.46 mol) of N-acetylpropanediamine (4-A) was dissolved in 100 ml of water. 108 g (0.93 mol) of sodium chloroacetate was added to the solution. 188 ml (0.94 mol) of a 5N aqueous solution of sodium hydroxide was added dropwise to the reaction mixture at room temperature with stirring while the pH value of the reaction system was kept at 10 to 11. The reaction system was further stirred for 10 hours. 95.2 ml (0.94 mol) of concentrated hydrochloric acid was added to the reaction system. The reaction system was then concentrated under reduced pressure. The resulting sodium chloride was removed by filtration. 200 ml of methanol was added to the filtrate. The resulting sodium chloride was removed by filtration, and the filtrate was then concentrated under reduced pressure. 300 ml of ethanol was added to the reaction system. The reaction system was then stored in a refrigerator. The resulting crystal was filtered off, and then recrystallized from a mixture of water and ethanol to obtain 80.2 g (0.35 mol) of Compound 4-B. (Yield: 75%)

4-(2): Synthesis of Compound 4-C 36.8 g (0.16 mol) of Compound 4-B obtained in 4-(1) was dissolved in 128 mol of a 5N aqueous solution of sodium hydroxide. The reaction mixture was then heated under reflux for 10 hours. The reaction system was allowed to cool to room temperature. 48.6 ml (0.48 mol) of concentrated hydrochloric acid was added to the reaction system. The reaction system was then concentrated under reduced pressure. The resulting salt was removed by filtration. 50 ml of concentrated hydrochloric acid was added to the filtrate. The resulting salt was removed by filtration, and the filtrate was then concentrated under reduced pressure. 50 ml of concentrated hydrochloric acid was added to the reaction system. The resulting salt was removed by filtration, and the filtrate was then concentrated under reduced pressure. 100 ml of methanol was added to the reaction system. The resulting salt was removed by filtration, and the filtrate was then concentrated under reduced pressure. 250 ml of ethanol was added to the reaction system. The reaction system was then stored in a refrigerator. The resulting crystal was filtered off, and then recrystallized from a mixture of water and ethanol to obtain 26.5 g (0.10 mol) of Compound 4-C. (Yield: 63%)

4-(3): Synthesis of Compound 2

7.91 g (0.03 mol) of Compound 4-C obtained in 4-(2) was dissolved in 20 ml of water. 12 ml (0.18 mol) of concentrated hydrochloric acid and 5.0 g (0.06 mol) of phosphorous acid were added to the reaction system. The reaction system was then heated under reflux. 9.8 g (0.12 mol) of a 37% aqueous solution of formalin was gradually added dropwise to the reaction system under reflux. After the completion of the dropwise addition, the reaction system was further heated under reflux for 3 hours. The reaction system was allowed to cool to room temperature, and then concentrated under reduced pressure. 50 ml of ethanol was added to the reaction system. A white pasty material was precipitated. Methanol and diethyl ether were added to the pasty material to obtain 7.19 g (0.02 mol) of a white solid material (Compound 2). (Yield: 69%; m.p. 138°-141° C. (decomposition))

In the present invention, the composition having a bleaching ability is a processing solution capable of bleaching (oxidizing) silver produced at the development step. Such a processing solution normally contains both a bleaching solution (bleaching bath) and a blixing solution (blixing bath).

In the present invention, an intermediate bath may be provided between the color development step and the processing step having a bleaching ability. However, the color development step is preferably followed immediately by the processing step having a bleaching ability to best attain the effects of the present invention.

In the present invention, the content of the ferric complex of organic acid represented by formula (I) or (II) in the processing solution having a bleaching ability as a bleaching agent is in the range of 0.05 to 2.5 mol/l, preferably in the range of 0.05 to 1.5 mol/l, particularly 0.1 to 0.8 mol/l.

The ferric complex of organic acid represented by formula (I) or (II) to be used in the present invention may be incorporated in the present processing solution in the form of isolated complex compound. Alternatively, such a ferric complex may be formed by mixing the organic acid and an iron salt (e.g., ferric sulfate, ferric nitrate, ferric chloride) in a solution. If such a ferric complex is used in the form of complex salt, one complex salt or two or more complex salts may be used. On the other hand, if a ferric salt and an organic acid represented by formula (I) or (II) are mixed in a solution to form a complex salt, one or more ferric salts may be used. Furthermore, one or more organic acids represented by formula (I) or (II) may be used. In either case, the organic acid represented by formula (I) or (II) can be used in excess of the amount such that ferric ions and complexes are produced.

Furthermore, the present ferric complex of organic acid can be used in combination with a known ferric complex of aminopolycarboxylic acid. Examples of aminopolycarboxylic acids or salts thereof to be contained in the ferric complex of aminopolycarboxylic acid include the following compounds:

B-1: Ethylenediaminetetraacetic acid
B-2: Disodium ethylenediaminetetraacetate
B-3: Diammonium ethylenediaminetetraacetate
B-4: Tetra(trimethylammonium) ethylenediaminetetraacetate
B-5: Tetrapotassium ethylenediaminetetraacetate
B-6: Tetrasodium ethylenediaminetetraacetate
B-7: Trisodium ethylenediaminetetraacetate
B-8: Diethylenetriaminepentaacetic acid
B-9: Pentasodium diethylenetriaminepentaacetate
B-10: Ethylenediamine-N-(B-oxyethyl)-N,N',N'-triacetic acid
B-11: Trisodium ethylenediamine-N-(β-oxyethyl)-N,N',N'-triacetate
B-12: Triammonium ethylenediamine-N-(β-oxyethyl)-N,N',N'-triacetate
B-13: 1,2-Diaminopropanetetraacetic acid
B-14: Disodium 1,2-diaminopropanetetraacetate
B-15: Nitrilotriacetic acid
B-16: Trisodium nitrilotriacetate
B-17: 1,2-Diaminocyclohexanetetraacetic acid
B-18: Disodium 1,2-diaminocyclohexanetetraacetate
B-19: Iminodiacetic acid
B-20: Dihydroxyethylglycine
B-21: Ethyletherdiaminetetraacetic acid
B-22: Glycoletherdiaminetetraacetic acid
B-23: Ethylenediaminetetrapropionic acid
B-24: 1,3-Diaminopropanetetraacetic acid One ferric complex of organic acid of the present invention and one ferric complex of aminopolycarboxylic acid can be used in combination. Alternatively, two or more ferric complexes of organic acid of the present invention and two or more ferric complexes of aminopolycarboxylic acid can be used in combination. The molar ratio of ferric complex of organic acid of the present invention to known ferric complex of aminopolycarboxylic acid is preferably in the range of 1/1 to 3/1.

Furthermore, the ferric complex of organic acid of the present invention can be used in combination with the above mentioned aminopolycarboxylic compounds.

The molar ratio of the ferric complex of organic acid to the ferric complex of the above mentioned ferric complex of aminopolycarboxylic acid is preferably in the range of 1/10 to 10/1, particularly 1/5 to 5/1.

The pH value of the present processing solution having a bleaching ability is in the range of 2 to 9, preferably 3 to 8, more preferably 4 to 8. Examples of pH buffers which can be incorporated in the present processing solution include known additives such as nitrate (e.g., sodium nitrate, ammonium nitrate), and inorganic or organic acid and salts thereof (e.g., boric acid, borax, sodium carbonate, sodium metaborate, acetic acid, sodium acetate, sodium carbonate, potassium carbonate, phosphorous acid, phosphoric acid, sodium phosphate, citric acid, sodium citrate, tartaric acid, lactic acid).

If the present processing solution having a bleaching ability is a bleaching solution, it preferably contains a rehalogenating agent such as bromide (e.g., potassium bromide, sodium bromide, ammonium bromide) and chloride (e.g., potassium chloride, sodium chloride, ammonium chloride). Particularly preferred among these rehalogenating agents are bromides. Particularly preferred among these bromides is ammonium bromide. The concentration of the rehalogenating agent is in the range of 0.1 to 5 mol, preferably 1.84 to 5 mol, particularly 1.84 to 3 mol per l of bleaching solution.

As metal corrosion inhibitor, ammonium nitrate is preferably used.

The processing solution having a bleaching ability according to the present invention can contain a bleaching accelerator.

Typical examples of such a bleaching accelerator include compounds containing a mercapto group or disulfide group as described in U.S. Pat. No. 3,893,858, German Patent 1,290,812, British Patent 1,138,842, JP-A-53-95630, and *Research Disclosure* No. 17129 (Jul. 1978), imidazole compounds as described in JP-A-49-40943, thiazolidine derivatives as described in JP-A-50-140129, thiourea derivatives as described in U.S. Pat. No. 3,706,561, iodides as described in JP-A-58-16235, polyethylene oxides as described in German Patent 2,748,430, and polyamine compounds as described in JP-B-45-8836 (the term "JP-B" as used herein means an "examined Japanese patent publication"). Particularly preferred among these compounds are mercapto compounds as described in British Patent 1,138,842.

These bleaching accelerators can be incorporated in a prebath of the present processing solution having a bleaching ability.

In the processing step of the present invention, the replenishment rate of the processing solution having a bleaching ability is in the range of generally 5 ml to 1 l, preferably 10 ml to 500 ml, particularly 10 ml to 300 ml per $m^2$ of light-sensitive material.

In the present processing step, the bleaching solution containing a ferric complex (III) is preferably bubbled with air (aeration) to reoxidize a ferrous complex (II) produced.

The aeration of a bleaching solution is known in the art. It is further described in Using Process C-41 (3rd edition, Z-121, 1982), Eastman Codak, page No. BL-2 or Monitoring the performance of the process C-41 bleach (Z-121D, 1982) that it is extremely important for the prevention of failure in desilvering and production of leuco cyan dye to fully aerate the bleaching solution so that it is in fully oxidized form.

It has been considered that since a bleaching solution containing a ferric complex oxidizes developed silver in the running process and receives a color developer from the previous step to produce a ferrous complex, it is important for the full accomplishment of bleach to fully aerate the bleaching solution so that the ferrous complex is fully oxidized to a ferric complex.

From the electrochemical standpoint of view, the oxidation state of the bleaching solution containing a ferric complex can be represented by the redox potential based on the ratio of amount of ferrous ion to ferric ion. U.S. Pat. No. 3,773,510 discloses that the redox potential in a blixing solution containing a ferric complex of ethylenediaminetetraacetate is increased to inhibit the production of leuco cyan dyes.

If the present processing solution having a bleaching ability is a blix solution, it can contain as fixing agent a known compound. Examples of such a compound include thiosulfate such as sodium thiosulfate, ammonium thiosulfate, ammonium sodium thiosulfate and potassium thiosulfate, thiocyanate such as sodium thiocyanate, ammonium thiocyanate and potassium thiocyanate, thiourea, and thioether. The amount of the fixing agent to be incorporated is preferably in the range of 3 mol/l or less, particularly 0.5 to 2 mol/l.

The light-sensitive material which has been processed with the present processing solution is then processed with a processing solution having a fixing ability (e.g., fixing solution, blixing solution). Typical examples of such a combination of processing steps include:

i. Bleaching bath—fixing bath;
ii. Bleaching bath—blixing bath;
iii. Bleaching bath—washing bath—fixing bath;
iv. Bleaching bath—blixing bath—fixing bath;
v. Blixing bath Each of these baths may consist of one tank or two or more tanks (e.g., 2 to 4 tanks). If these baths consist of two or more processing tanks, these steps are preferably effected in a countercurrent replenishment process.

As fixing agent to be incorporated in the processing solution having a fixing ability there can be used a fixing agent which can be incorporated in the above mentioned blixing solution.

In order to accelerate fixation, the processing solution having a fixing capability may preferably also contain the above mentioned ammonium thiocyanate (Rhodan ammonium), thiourea, or thioether (e.g., 3,6-dithia-1,8-octanediol). The amount of such a compound to be used in combination is normally in the range of 0.01 to 0.1 mol per liter of fixing solution or blixing solution. If desired, such a compound can be incorporated in an amount of 1 to 3 mol per l of fixing solution or blixing solution to drastically improve the effect of accelerating fixation.

The fixing solution or blixing solution to be used after the present processing solution having a bleaching capability may comprise as preservative bisulfate addition products of sodium sulfite, potassium sulfite, ammonium sulfite, and hydroxylamine, hydrazine, and aldehyde compounds, such as sodium acetoaldehydebisulfite. The fixing solution or blixing solution may also comprise various fluorescent brightening agents, antifoaming agent or surface active agents, and organic solvents such as polyvinyl pyrrolidone and methanol. Particularly preferred preservatives are sulfinic acid compounds as described in JP-A-62-143048.

The blixing solution to be used after the present processing solution having a bleaching ability may comprise the above mentioned bleaching agents besides the present ferric complex of organic acid. Preferred examples of such a known bleaching agent include ferric complexes of aminopolycarboxylic acid.

The content of the bleaching agent in the blixing solution to be used after the present processing solution having a bleaching ability is in the range of generally 0.01 to 0.5 mol, preferably 0.02 to 0.3 mol, particularly 0.03 to 0.2 mol per l of blixing solution.

In the present invention, the initial blixing solution (i.e., tank solution) is prepared by dissolving in water the above mentioned compounds to be incorporated in the blixing solution but may be prepared by mixing a bleaching solution and a fixing solution which have been separately prepared in a proper ratio. The pH value of the fixing solution is preferably in the range of 5 to 9, more preferably 6.5 to 8. The pH value of the blixing solution is preferably in the range of 6 to 8.5, more preferably 6.5 to 8.0.

In order to inhibit bleaching fog, the fixing solution or blixing solution to be used in the present invention may preferably contain at least one compound having a pKa value of 6.0 to 9.0 so that the above-specified pH range is reached.

Typical examples of such a compound include aziridine, imidazoles such as imidazole, 1-ethyl-imidazote, 1-methyl-imidazole, and 2-methyl-imidazole, N-allylmorpholine, and 1-benzoylpiperadine.

The amount of such a compound to be incorporated is in the range of generally 0.1 to 10 mol/l, preferably 0.2 to 3 mol/l.

The replenishment rate of the fixing solution or blixing solution to be used after the present processing solution having a bleaching ability is preferably in the range of generally 300 to 3,000 ml, more preferably 300 to 1,300 ml per $m^2$ of light-sensitive material.

The fixing solution or blixing solution to be used after the present processing solution having a bleaching ability may preferably comprise various aminopolycarboxylic acis or organic phosphonic acids for the purpose of stabilizing the solution.

The shorter the total desilvering time is, the more remarkably can be accomplished the effects of the present invention. The total desilvering time is preferably in the range of 5 seconds to 4 minutes, more preferably 30 seconds to 3 minutes. The desilvering temperature is in the range of generally 25° to 50° C., preferably 35° to 45° C. In this preferred temperature range, the desilvering rate can be improved, and the occurrence of stain after processing can be effectively inhibited.

In the desilvering step, the agitation is preferably intensified as much as possible to more effectively accomplish the effects of the present invention.

In particular, the agitation can be intensified by various methods. For example, the processing solution may be jetted to the surface of the emulsion layer in the light-sensitive material as described in JP-A-62-183460 and JP-A-62-183461. The agitating effect can be improved by a rotary means as described in JP-A-62-183461. Furthermore, the agitating effect can be improved by moving the light-sensitive material with the emulsion surface in contact with a wiper blade provided in the bath so that a turbulence occurs on the emulsion surface. Moreover, the agitation can be intensified by increasing the total circulated amount of processing solution. Such an agitation improving method can be effectively applied to the bleaching bath, blixing bath or fixing bath. The improvement in agitation effect expedites the supply of a bleaching agent, fixing agent or the like into the emulsion film, resulting in an improvement in desilvering rate.

The above mentioned agitation improving method is more effective when a bleaching accelerator is used. In this case, the agitation improving method can remarkably enhance the bleach accelerating effect or eliminate the effect of inhibiting fixation by the bleaching accelerator.

The automatic developing machine to be used in the present invention is preferably equipped with a light-sensitive material conveying means as described in JP-A-60-191257, JP-A-60-191258, and JP-A-60-191259. As described in the above cited JP-A-60-191257, such a conveying means can remarkably reduce the amount of the processing solution carried over from a bath to its succeeding bath, exhibiting a high effect of inhibiting the deterioration of properties of the processing solution. Such an effect is particularly effective for the reduction of processing time at each step or the replenishment rate of the processing solution.

The color developer to be used in the present invention comprises a known aromatic primary amine color developing agent. Preferred examples of such an aromatic primary amine color developing agent include p-phenylenediamine derivatives. Specific examples of such p-phenylenediamine derivatives will be set forth below, but the present invention should not be construed as being limited thereto.

D-1: N,N-diethyl-p-phenylenediamine
D-2: 2-Amino-5-diethylaminotoluene
D-3: 2-Amino-5-(N-ethyl-N-laurylamino)toluene
D-4: 4-[N-ethyl-N-(B-hydroxyethyl)amino]aniline
D-5: 2-Methyl-4-[N-ethyl-N-[B-hydroxyethyl-)amino]aniline
D-6: 4-Amino-3-methyl-N-ethyl-N-[B-(methanesulfonamide)ethyl]aniline
D-7 : N-(2-amino-5-diethylaminophenylethyl)methanesulfonamide
D-8 : N,N-dimethyl-p-phenylenediamine
D-9: 4-Amino-3-methyl-N-ethyl-N-methoxyethylaniline
D-10: 4-Amino-3-methyl-N-ethyl-N-B-ethoxyethylaniline
D-11: 4-Amino-3-methyl-N-ethyl-N-$\beta$-butoxyethylaniline Particularly preferred among these p-phenylenediamine derivatives are D-5 and D-6.

These p-phenylenediamine derivatives may be used in the form of salt such as sulfate, hydrochloride, sulfite and p-toluenesulfonate. The amount of the aromatic primary amine color developing agent to be used is preferably in the range of about 0.1 g to about 20 g, more preferably about 0.5 g to about 10 g per l of the color developer.

If desired, the color developer may contain as preservative a sulfite such as sodium sulfite, potassium sulfite, sodium bisulfite, potassium bisulfite, sodium metasulfite and potassium metasulfite or a carbonyl-sulfurous acid addition product.

The amount of such a preservative to be incorporated is preferably in the range of 0.5 to 10 g, more preferably 1 to 5 g per l of the color developer.

Furthermore, the color developer may preferably contain as compound for directly preserving the aromatic primary amine color developing agent various hydroxylamines, hydroxamic acids as described in JP-A-63-43138, hydrazines and hydrazides as described in JP-A-63-146041 and JP-A-63-170642, phenols as described in JP-A-63-44657 and JP-A-63-58443, $\alpha$-hydroxyketones and $\alpha$-aminoketones as described in JP-A-63-44656, and/or various saccharides as described in JP-A-63-36244. These compounds may be preferably used in combination with monoamines as described in JP-A-63-4235, JP-A-63-24254, JP-A-63-21647, JP-A-63-146040, JP-A-63-27841, and JP-A-63-25654, diamines as described in JP-A-63-30845, JP-A-63-146040, and JP-A-63-43139, polyamines as described in JP-A-63-21647, and JP-A-63-26655, polyamines as described in JP-A-63-44655, nitroxy radicals as described in JP-A-63-53551, alcohols as described in JP-A-63-43140 and JP-A-63-53549, oxims as described in JP-A-63-56654, and tertiary amines as described in JP-A-63-239447.

Other examples of preservatives which can be incorporated in the color developer as necessary include various metals as described in JP-A-57-44148 and JP-A-57-53749, salicylic acids as described in JP-A-59-180588, alkanolamines as described in JP-A-54-3532, polyethyleneimines as described in JP-A-56-94349, and aromatic polyhydroxy compounds as described in U.S. Pat. No. 3,746,544. In particular, aromatic polyhydroxy compounds may be preferably used.

The color developer to be used in the present invention preferably has a pH value of 9 to 21, more preferably 9 to 11.0. The color developer may further contain compounds which have been known to constitute color developers.

In order to maintain the above specified pH range, various buffers may be preferably used.

Specific examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention should not be construed as being limited to these compounds.

The amount of the buffer to be incorporated in the color developer is preferably in the range of 0.1 mol/l or more, particularly 0.1 to 0.4 mol/l.

The color developer may further comprise various chelating agents as calcium or magnesium suspending agents or to improve the stability thereof.

As such chelating agents there can be preferably used organic acid compounds. Examples of such organic acid compounds include aminopolycarboxylic acids, organic phosphonic acids, and phosphonocarboxylic acids. Specific examples of such organic acid compounds will be set forth below, but the present invention should not be construed as being limited thereto.

Nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycoletherdiaminetetraacetic acid, ethylenediamineorthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid.

Two or more such chelating agents can be used in combination if desired.

The proper amount of such a chelating agent to be incorporated in the color developer is such that it suffices to block metal ions in the color developer, e.g., 0.1 to 10 g/l.

The color developer may optionally comprise any developing accelerators. However, the color developer to be used in the present invention preferably contains substantially no benzyl alcohol in the light of environmental pollution, ease of preparation, and inhibition of color stain. This means that the color developer may contain benzyl alcohol in an amount of 2 ml or less per l of color developer, preferably none at all.

Other examples of developing accelerators which can be incorporated in the color developer include thioether compounds as disclosed in JP-B-37-16088, JP-B-37-5987, JP-B-38-7826, JP-B-44-12380, and JP-B-45-9019, and U.S. Pat. No. 3,813,247, p-phenylenediamine compounds as disclosed in JP-A-52-49829 and JP-A-50-15554, tertiary ammonium salts as disclosed in JP-A-50-137726, JP-A-56-156826 and JP-A-52-43429, and JP-B-

44-30074, amine compounds as disclosed in U.S. Pat. Nos. 2,494,903, 3,128,182, 4,230,796, 3,253,919, and 2,482,546, and JP-B-41-11431, polyalkylene oxides as disclosed in JP-B-37-16088, JP-B-42-25201, JP-B-41-11431, and JP-B-42-23883, and U.S. Pat. Nos. 3,128,183, and 3,532,501, 1-phenyl-3pyrazolidones, and imidazoles.

The color developer to be used in the present invention can comprise any fog inhibitors if desired. As such fog inhibitors there can be used a halide of alkali metal such as sodium chloride, potassium bromide and potassium iodide or an organic fogging inhibitor. Typical examples of such an organic fog inhibitor include nitrogen-containing heterocyclic compounds such as benzotriazole, 6-nitrobenzimidazole, 5-nitroindazole, 5-methylbenzotriazole, 5-nitrobenzotriazole, 5-chlorobenzotriazole, 2-thiazolyl-benzimidazole, 2-thiazolyl-methylbenzimidazole, indazole, hydroxyazaindolidine, and adenine, mercapto-substituted heterocyclic compounds such as 1-phenyl-5-mercaptotetrazole, 2-mercaptobenzimidazole, and 2-mercaptobenzothiazole, and mercapto-substituted aromatic compounds such as thiosalicylic acid.

These fogging inhibitors may be eluted from the color light-sensitive material with the developer during processing.

The color developer to be used in the present invention may comprise a fluorescent brightening agent. As such a fluorescent brightening agent there can be preferably used 4,4'-diamino-2,2'-disulfostilbene compound. The amount of such a fluorescent brightening agent to be incorporated in the color developer is in the range of generally 0 to 5 g/l, preferably 0.1 to 4 g/l.

The color developer to be used in the present invention may comprise various surface active agents such as alkylsulfonic acid, arylsulfonic acid, aliphatic carboxylic acid and aromatic carboxylic acid if desired.

The temperature at which the present processing is effected with the color developer is in the range of generally 20° to 50° C., preferably 30° to 45° C. The time during which the present processing is effected with the color developer is in the range of generally 20 seconds to 5 minutes, preferably 30 seconds to 195 seconds. The less replenishment rate of the present color developer is used, the better can be accomplished the effects of the present invention. In particular, the replenishment rate of the color developer is in the range of generally 100 to 1,500 ml, preferably 100 to 1,000 ml, more preferably 200 to 900 ml per $m^2$ of the light-sensitive material.

The color developing bath may optionally consist of two or more baths wherein the replenisher of the color developer is supplied from the forefront bath or the last bath to reduce the developing time or the replenishment rate.

The present processing method can be applied to color reversal processing. The black-and-white developer to be used in the color reversal processing is a 1st black-and-white developer to be used in the reversal processing of commonly known color light-sensitive materials. Well known various additives which have been incorporated in black-and-white developers which have been widely used for processing solutions for black-and-white silver halide photographic materials can be incorporated in the 1st black-and-white developer for color reversal light-sensitive materials.

Typical examples of such additives include developing agents such as 1-phenyl-3-pyrazolidone, methol and hydroquinone, preservatives such as sulfite, accelerators comprising alkali such as sodium hydroxide, sodium carbonate and potassium carbonate, inorganic or organic inhibitors such as potassium bromide, 2-methylbenzimidazole and methylbenzthiazole, hard water softening agents such as polyphosphoric acid salt, iodides (in a slight amount), and development inhibitors comprising mercapto compound.

The present processing process consists of the above mentioned color development step, bleaching step, blixing step, fixing step, etc. The bleaching or blixing step is normally followed by a processing step such as rinsing and stabilization. Alternatively, a simple processing step may be effected wherein the processing step having a fixing ability is followed by a stabilizing step without a substantial rinsing.

The rinsing solution to be used in the rinsing step can comprise known additives as necessary. Examples of such known additives include hard water softening agents such as inorganic phosphoric acid, aminopolycarboxylic acid and organic phosphoric acid, germicides and anti-fungal agents for preventing the preliferation of various bacteria and algae (e.g., isothiazolone, organic chlorine germicide, benzotriazole), and surface active agents for inhibiting drying load and unevenness. Furthermore, compounds as described in L. E. West, "Water Quality Criteria", *Phot. Sci. and Eng.*, vol. 9, No. 6, page 344–359, 1965 can be used.

As the stabilizing solution to be used in the stabilizing step there can be used a processing solution for stabilizing dye images. Examples of such a processing solution include solution with a pH value of 3 to 6 having a buffering ability, and solution containing an aldehyde (e.g., formalin). The stabilizing solution may contain an ammonium compound, metallic compound such as Bi and Al, fluorescent brightening agent, chelating agent (e.g., 1-hydroxyethylidene-1,1-diphosphonic acid), germicide, anti-fungal agent, film hardener, surface active agent, and alkanolamine.

The rinsing step or stabilizing step is preferably effected in a multistage countercurrent process. The number of stages is preferably 2 to 4. The replenishment rate of the rinsing solution or stabilizing solution is generally 1 to 50 times, preferably 2 to 30 times, more preferably 2 to 15 times the amount of the rinsing solution or stabilizing solution to be brought over from the prebath per unit area.

As water to be used in the rinsing step or stabilizing step there may be preferably used tap water, water obtained by deionizing water with an ion exchange resin so that Ca and Mg concentrations are each reduced to 5 mg/l or less, and water sterilized by halogen, ultraviolet ray, etc.

In the above mentioned processing step for color light-sensitive material, if an automatic developing machine is used to effect a continuous processing, the concentration of the processing solution may occur due to evaporation. This trouble becomes remarkable particularly when the amount of the light-sensitive material to be processed is small or the open area value of the processing solution is large. In order to make up for the concentration of the processing solution, a proper amount of water or correcting solution may be preferably supplied.

The overflow solution from the rinsing step or stabilizing step can be flown into a bath having a fixing ability to reduce the amount of the processing solution to be discharged.

The present color photographic light-sensitive material for photographing can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support side. However, the order of arrangement can be optionally reversed depending on the purpose of application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further contain a color stain inhibitor, ultraviolet absorbent, stain inhibitor, etc. as commonly used.

The plurality of silver halide emulsion layers constituting each unit light-sensitive layer can be preferably in a two-layer structure, i.e., high-speed emulsion layer and low-speed emulsion layer, as described in German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and 62-206543, a low-speed emulsion layer can be provided remote from the support while a high-speed emulsion layer can be provided nearer to the support.

In an embodiment of such an arrangement, a low-speed blue-sensitive layer (BL), a high-speed blue-sensitive layer (BH), a high-speed green-sensitive layer (GH), a low-speed green-sensitive layer (GL), a high-speed red-sensitive layer (RH), and a low-speed red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B-55-34932, a blue-sensitive layer, GH, RH, GL, and RL can be arranged in this order remote from the support. Alternatively, as described in JP-A-56-25738 and JP-A-62-63936, a blue-sensitive layer, GL, RL, GH, and RH can be arranged in this order remote from the support.

As described in JP-B-49-15495, the upper layer which is a silver halide emulsion layer having the highest sensitivity, the intermediate layer which is a silver halide emulsion layer having lower sensitivity than the upper layer and the under layer which is a silver halide emulsion layer having lower sensitivity than the intermediate layer can be arranged in this order remote from the support. In this structure comprising three layers having the different sensitivities, as described in JP-A-59-202464, a medium-speed emulsion layer, a high-speed emulsion layer and a low-speed emulsion layer can be arranged in this order remote from the support in the layers having the same color sensitivity.

As described above, various layer structures and arrangements can be selected depending on the purpose of light-sensitive material.

Any of these layer arrangements can be applied to the color light-sensitive material of the present invention. In the present invention, the dried thickness of all the constituting layers of the color light-sensitive material except for support and its subbing layer is preferably in the range of 20.0 μm or less, more preferably 18.0 μm or less to accomplish the objects of the present invention.

The specification of the dried film thickness is based on the color developing agent to be incorporated into these constituting layers during and after processing. This means that bleaching fog or stain generated during the storage of images after processing depends greatly on the amount of the remaining color developing agent. In respect to the occurrence of bleaching fog or stain, the increase in magenta color probably due to the green-sensitive layer is greater than that in cyan and yellow colors.

The lower limit of the specified film thickness is preferably lowered from the above mentioned specification to such an extent that the properties of the light-sensitive material is not remarkably deteriorated. The lower limit of the total dried thickness of the layers constituting the light-sensitive material except support and its subbing layer is 12.0 μm. The lower limit of the total dried thickness of the constituting layers provided between the light-sensitive layer nearest to the support and the subbing layer of the support is 1.0 μm.

The reduction of the film thickness may be effected in either light-sensitive layer or light-insensitive layer.

The film thickness of the multilayer color light-sensitive material of the present invention can be determined in accordance with the following method:

The light-sensitive material specimen is stored at a temperature of 25° C. and a relative humidity of 50% for 7 days. The total thickness of the specimen is determined. The coating layers are then removed from the support. The thickness of the support is determined. The difference in the two measurements is the total thickness of the coating layers. The measurement of the film thickness can be accomplished by means of a contact type thickness meter comprising a piezoelectric element (e.g., K-402B Stand, manufactured by Anritus Electric Co., Ltd.). The removal of the coating layers from the support can be effected by the use of an aqueous solution of sodium hypochlorite.

A section of the specimen is photographed by a scanning type electron microscope preferably at magnifications of 3,000 or more. The total thickness of the coating layers on the support and the thickness of each of these coating layers are measured and compared to the measured value of the total thickness of the coating layers obtained by the film thickness meter (absolute value of the measured thickness) to calculate the thickness of each of these coating layers.

The percent swelling of the light-sensitive material of the present invention [determined by (equilibrium swollen film thickness in water at 25° C.—total dried film thickness at 25° C., 55% RH/total dried film thickness at 25° C., 55% RH)×100] is preferably in the range of 50 to 200%, more preferably 70 to 150%. If this value deviates from the above specified range, the remaining amount of the color developing agent increases, giving adverse effects on photographic properties, desilvering property and other picture qualities, and film physical properties such as film strength.

The swelling rate of the light-sensitive material of the present invention (as determined by T ½, which is defined by the time required to reach half the saturated swollen film thickness (90% of the maximum swollen film thickness in the color developer (at a temperature of 30° C., 195 seconds)) is preferably in the range of generally 15 seconds or less, more preferably 9 seconds or less.

The silver halide to be incorporated in the photographic emulsion layer in the color light-sensitive material of the present invention may be any silver halide composition such as silver chloride, silver bromide, silver bromochloride, silver bromoiodide, silver chloroiodide and silver bromochloroiodide.

Silver halide grains in the photographic emulsions may be so-called regular grains having a regular crystal form, such as cube, octahedron and tetradecahedron, or those having an irregular crystal form such as sphere and tabular form, those having a crystal defect such as twinning plane, or those having a combination of these crystal forms.

The silver halide grains may be either fine grains of about 0.2 μm or smaller in diameter or giant grains having a projected area diameter of up to about 10 μm. The emulsion may be either a monodisperse emulsion or a polydisperse emulsion.

The preparation of the silver halide photographic emulsion which can be used in the present invention can be accomplished by any suitable method as described in *Research Disclosure* No. 17643 (December 1978), pp. 22–23, "I. Emulsion Preparation and Types", and No. 18716 (November 1979), page 648, Glafkides, "Chimie et Physique Photographique", Paul Montel (1967), G. F. Duffin, "Photographic Emulsion Chemistry", Focal Press, 1966, and V. L. Zelikman et al., "Making and Coating Photographic Emulsion Focal Press", 1964.

Furthermore, monodisperse emulsions as described in U.S. Pat. Nos. 3,574,628 and 3,655,394, and British Patent 1,413,748 can be preferably used in the present invention.

Tabular grains having an aspect ratio of:about 5 or more can be used in the present invention. The preparation of such tabular grains can be easily accomplished by any suitable method as described in Gutoff, "Photographic Science and Engineering", vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc. by an epitaxial junction.

Mixtures of grains having various crystal forms may also be used.

The silver halide emulsion to be used in the present invention is normally subjected to physical ripening, chemical ripening and spectral sensitization. Additives to be used in these steps are described in *Research Disclosure* Nos. 17643 and 18716 as shown below.

Known photographic additives which can be used in the present invention are described in the above-cited two *Research Disclosures* as shown below.

| Kind of additive | RD17643 | RD18716 |
|---|---|---|
| 1. Chemical sensitizer | p. 23 | p. 648 right column (RC) |
| 2. Sensitivity increasing agent | — | " |
| 3. Spectral sensitizer and supersensitizer | pp. 23–24 | p. 648 RC–p. 649 RC |
| 4. Brightening agent | p. 24 | — |
| 5. Antifoggant and stabilizer | pp. 24–25 | p. 649 RC– |
| 6. Light absorbent, filter dye, and ultraviolet absorbent | pp. 25–26 | p. 649 RC–p.650 left column (LC) |
| 7. Stain inhibitor | p. 25 RC | p. 650 LC–RC |
| 8. Dye image stabilizer | p. 25 | — |
| 9. Hardening agent | p. 26 | p. 651 LC |
| 10. Binder | p. 26 | " |
| 11. Plasticizer and lubricant | p. 27 | p. 650 RC |
| 12. Coating aid and surface active agent | pp. 26–27 | " |
| 13. Antistatic agent | p. 27 | " |

Various color couplers can be used in the present invention. Specific examples of the color couplers are described in the patents described in the above cited *Research Disclosure* No. 17643, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, 60-43659, 61-72238, 60-35730, 55-118034, and 60-185951, RD Nos. 24220 (June 1984) and 24230 (June 1984), and WO(PCT)88/04795. The effects of the present invention on bleach fogging and stain become remarkable particularly with pyrazoloazole couplers.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,753,871, 4,451,559, 4,427,767, 4,690,889, 4,254,212, 4,254,212, and 4,296,199, West German Patent (DT-OS) No. 3,329,729, European Patents 121,365A and 249,453A, and JP-A-61-42658.

Colored couplers for correction of unnecessary absorptions of the developed color preferably include those described in Research Disclosure No. 17643, VII-G, U.S. Pat. Nos. 4,163,670, 4,004,929, and 4,138,258, JP-B-57-39413, and British Patent 1,146,368. Furthermore, couplers for correction of unnecessary absorptions of the developed color by a fluorescent dye released upon coupling as described in U.S. Pat. No. 4,774,181 and couplers containing as a releasing group a dye precursor group capable of reacting with a developing agent to form a dye as described in U.S. Pat. No. 4,777,120 can be preferably used.

Couplers which form a dye having moderate diffusibility preferably include those described in U.S. Pat. No. 4,366,237, British Patent 2,125,570, European Patent 96,570, and West German Patent (DT-OS) No. 3,234,533.

Typical examples of polymerized dye-forming couplers are described in U.S. Pat. Nos. 3,451,820, 4,080,211, 4,367,282, 4,409,320, and 4,576,910, British Patent 2,102,173, and British Patent 2,102,173.

Couplers capable of releasing a photographically useful residual upon coupling can also be used in the present invention. Preferred examples of DIR couplers which release a developing inhibitor are described in the patents cited in RD 17643, VII-F, and JP-A-57-151944, 57-154234, 60-184248, and 63-37346, and U.S. Pat. Nos. 4,248,962, and 4,782,012.

Couplers capable of imagewise releasing a nucleating agent or a developing accelerator at the time of development preferably include those described in British Patents 2,097,140 and 2,131,188, and JP-A-59-157638 and 59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compounds or DIR couplers or DIR coupler-releasing couplers as described in JP-A-60-185950 and 62-24252, couplers capable of releasing a dye which returns to its original color after release as described in European Patent 173,302A, couplers capable of releasing a bleaching accelerator as described in RD Nos. 11449 and 24241, and JP-A-61-201247, couplers capable of releasing a ligand as described in U.S. Pat. No. 4,553,477, couplers capable of releasing a leuco dye as described in JP-A-63-75747, and couplers capable of releasing a fluorescent dye as described in U.S. Pat. No. 4,774,181.

The incorporation of these couplers in the light-sensitive material can be accomplished by any suitable known dispersion method.

Examples of high boiling solvents to be used in the oil-in-water dispersion process are described in U.S. Pat. No. 2,322,027. Specific examples of high boiling point organic solvents having a boiling point of 175° C. or higher at normal pressure which can be used in the oil-in-water dispersion process include phthalic esters (e.g., dibutyl phthalate, dicylcohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Application (OLS) 2,541,274, and 2,541,230.

These couplers can impregnate a loadable latex polymer (as described in U.S. Pat. No. 4,203,716) in the presence or absence of the above mentioned high boiling organic solvent or can be dissolved in a water-insoluble and organic solvent-soluble polymer before being emulsion-dispersed in an aqueous solution of hydrophilic colloid.

Preferably, single polymers or copolymers as described in International Patent Disclosure No. WO88/00723, pp. 12–30 can be used. In particular, acrylamide polymers may be preferably used for the purpose of stabilizing dye images or like purposes.

Suitable supports which can be used in the present invention are described in the above cited RD 17643 (page 28) and 18716 (right column on page 647 to left column on page 648).

The present invention can be applied to various color light-sensitive materials such as color negative films for motion picture, color reversal film for slide or television, color paper, color positive film and color reversal paper.

The present invention will be further described in the following examples, but the present invention should not be construed as being limited thereto.

EXAMPLE 1

A multilayer color light-sensitive material was prepared as Specimen 101 by coating on a undercoated cellulose triacetate film support various layers having the following compositions.

Composition of light-sensitive layer

The coated amount of silver halide and colloidal silver is represented in g/m$^2$ as calculated in terms of amount of silver. The coated amount of sensitizing dye is represented in mol per mol of silver halide contained in the same layer.

| | |
|---|---|
| 1st Layer: anti-halation layer | |
| Black colloidal silver | 0.2 |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| 2nd Layer: interlayer | |
| Finely divided silver bromide grains (diameter: 0.07 μm as calculated in terms of sphere) | 0.15 (as silver) |
| Gelatin | 1.0 |
| Cpd-2 | 0.2 |
| 3rd layer: 1st red-sensitive emulsion layer | |
| Silver bromoiodide emulsion (AgI content: 10.0 mol %; high internal AgI type; diameter: 0.7 μm (as calculated in terms of sphere); coefficient of fluctuation in grain diameter: 14% (as calculated in terms of sphere; tetradecahedral grains) | 0.26 (as silver) |
| Silver bromoiodide emulsion (AgI content: 4.0 mol %; high internal AgI type; diameter: 0.4 μm (as calculated | 0.2 (as silver) |

-continued

| | |
|---|---|
| in terms of sphere); coefficient of fluctuation in grain diameter: 22% (as calculated in terms of sphere; tetradecahedral grains) | |
| Gelatin | 1.0 |
| ExS-1 | $4.5 \times 10^{-4}$ mol |
| ExS-2 | $1.5 \times 10^{-4}$ mol |
| ExS-3 | $0.4 \times 10^{-4}$ mol |
| ExS-4 | $0.3 \times 10^{-4}$ mol |
| ExC-1 | 0.15 |
| ExC-7 | 0.15 |
| ExC-2 | 0.009 |
| ExC-3 | 0.023 |
| ExC-6 | 0.14 |
| 4th Layer: 2nd red-sensitive emulsion layer | |
| Silver bromoiodide emulsion (AgI content: 16 mol %; high internal AgI type; diameter: 1.0 μm (as calculated in terms of sphere); coefficient of fluctuation in grain diameter: 25% (as calculated in terms of sphere; tabular grains; diameter/thickness ratio: 4.0) | 0.55 (as silver) |
| Gelatin | 0.7 |
| ExS-1 | $3 \times 10^{-4}$ mol |
| ExS-2 | $1 \times 10^{-4}$ mol |
| ExS-3 | $0.3 \times 10^{-4}$ mol |
| ExS-4 | $0.3 \times 10^{-4}$ mol |
| ExC-3 | 0.05 |
| ExC-4 | 0.10 |
| ExC-6 | 0.08 |
| 5th Layer: 3rd red-sensitive emulsion layer | |
| Silver bromoiodide emulsion (AgI content: 10.0 mol %; high internal AgI type; diameter: 1.2 μm (as calculated in terms of sphere); coefficient of fluctuation in grain diameter: 28% (as calculated in terms of sphere; tabular grains; diameter/thickness ratio: 6.0) | 0.9 (as silver) |
| Gelatin | 0.6 |
| ExS-1 | $2 \times 10^{-4}$ mol |
| ExS-2 | $0.6 \times 10^{-4}$ mol |
| ExS-3 | $0.2 \times 10^{-4}$ mol |
| ExC-4 | 0.07 |
| ExC-5 | 0.06 |
| Solv-1 | 0.12 |
| Solv-2 | 0.12 |
| 6th Layer: interlayer | |
| Gelatin | 0.60 |
| Cpd-4 | 0.1 |
| 7th Layer: 1st green-sensitive emulsion layer | |
| Silver bromoiodide emulsion (AgI content: 10.0 mol %; high internal AgI type; diameter: 0.7 μm (as calculated in terms of sphere); coefficient of fluctuation in grain diameter: 14% (as calculated in terms of sphere; tetradecahedral grains) | 0.2 (as silver) |
| Silver bromoiodide emulsion (AgI content: 14.0 mol %; high internal AgI type; diameter: 0.4 μm (as calculated in terms of sphere); coefficient of fluction in grain diameter: 22% (as calculated in terms of sphere; tetradecahedral grains) | 0.1 (as silver) |
| Gelatin | 1.2 |
| ExS-5 | $5 \times 10^{-4}$ mol |
| ExS-6 | $2 \times 10^{-4}$ mol |
| ExS-7 | $1 \times 10^{-4}$ mol |
| ExM-1 | 0.20 |
| ExM-6 | 0.25 |
| ExM-2 | 0.10 |
| ExM-4 | 0.03 |
| Solv-1 | 0.40 |
| Solv-5 | 0.03 |
| 8th Layer: 2nd green-sensitive emulsion layer | |
| Silver bromoiodide emulsion (AgI content: 10.0 mol %; high internal iodine type; diameter: 1.0 μm (as calculated in terms of sphere); coefficient of fluctuation in grain diameter: 25% (as calculated in terms of sphere; tabular grains; diameter/thickness ratio: 3.0) | 0.4 (as silver) |
| Gelatin | 0.35 |
| ExS-5 | $3.5 \times 10^{-4}$ mol |
| ExS-6 | $1.4 \times 10^{-4}$ mol |
| ExS-7 | $0.7 \times 10^{-4}$ mol |
| ExM-1 | 0.09 |
| ExM-3 | 0.01 |
| Solv-1 | 0.15 |
| Solv-4 | 0.03 |
| 9th Layer: interlayer | |
| Gelatin | 0.5 |
| 10th Layer: 3rd green-sensitive emulsion layer | |
| Silver bromoiodide emulsion (AgI content: 10.0 mol %; high internal AgI type; diameter: 1.2 μm (as calculated in terms of sphere); coefficient of fluctuation in grain diameter: 28% (as calculated in terms of sphere; tabular grains; diameter/thickness ratio: 6.0) | 1.0 (as silver) |
| Gelatin | 0.8 |
| ExS-5 | $2 \times 10^{-4}$ mol |
| ExS-6 | $0.8 \times 10^{-4}$ mol |
| ExS-7 | $0.8 \times 10^{-4}$ mol |
| ExM-3 | 0.01 |
| ExM-4 | 0.04 |
| ExC-4 | 0.005 |
| Solv-1 | 0.2 |
| 11th Layer: yellow filter layer | |
| Cpd-3 | 0.05 |
| Gelatin | 0.5 |
| Solv-1 | 0.1 |
| 12th Layer: interlayer | |
| Gelatin | 0.5 |
| Cpd-2 | 0.1 |
| 13th Layer: 1st blue-sensitive layer | |
| Silver bromoiodide emulsion (AgI content: 10 mol %; high internal iodine type; diameter: 0.7 μm (as calculated in terms of sphere); coefficient of fluctuation in grain diameter: 14% (as calculated in terms of sphere; tetradecahedral grains) | 0.1 (as silver) |
| Silver bromoiodide emulsion (AgI content: 4.0 mol %; high internal iodine type; diameter: 0.4 μm (as calculated in terms of sphere); coefficient of fluctuation in grain diameter: 22% (as calculated in terms of sphere; tetradecahedral grains) | 0.05 (as silver) |
| Gelatin | 1.0 |
| ExS-8 | $3 \times 10^{-4}$ mol |
| ExY-1 | 0.25 |
| ExY-3 | 0.32 |
| ExY-2 | 0.02 |
| Solv-1 | 0.20 |
| 14th Layer: 2nd blue-sensitive emulsion layer | |
| Silver bromoiodide emulsion (AgI content: 19.0 mol %; high internal AgI type; diameter: 1.0 μm (as calculated | 0.19 (as silver) |

-continued

| | |
|---|---|
| in terms of sphere); coefficient of fluctuation in grain diameter: 16% (as calculated in terms of sphere; tetradecahedral grains) | |
| Gelatin | 0.3 |
| ExS-8 | $2 \times 10^{-4}$ mol |
| ExY-1 | 0.22 |
| Solv-1 | 0.07 |
| 15th Layer: interlayer | |
| Finely divided silver bromoiodide (AgI content: 2 mol %; uniform type; grain diameter: 0.13 μm as calculated in terms of sphere) | 0.2 (as silver) |
| 16th layer: 3rd blue-sensitive emulsion layer | |
| Silver bromoiodide emulsion (AgI content: 14.0 mol %; high internal AgI type; grain diameter: 1.5 μm as calculated in terms of sphere; coefficient of fluctuation in grain diameter: 28% as calculated in terms of sphere; tabular grains; diameter/thickness ratio: 5.0) | 1.0 (as silver) |
| Gelatin | 0.5 |
| ExS-8 | $1.5 \times 10^{-4}$ |
| ExY-1 | 0.2 |
| Solv-1 | 0.07 |
| 17th layer: 1st protective layer | |
| Gelatin | 1.8 |
| UV-1 | 0.1 |
| UV-2 | 0.2 |
| Solv-1 | 0.01 |
| Solv-2 | 0.01 |
| 18th layer: 2nd protective layer | |
| Finely divided silver bromide grains (grain diameter: 0.07 μm as calculated in terms of sphere) | 0.18 (as silver) |
| Gelatin | 0.7 |
| Polymethyl methacrylate grains (grain diameter: 1.5 μm) | 0.2 |
| W-1 | 0.02 |
| H-1 | 0.4 |
| Cpd-5 | 1.0 |

UV-1

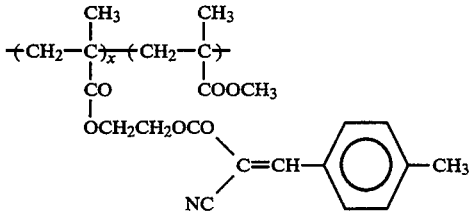

x/y = 7/3 (by weight)

UV-2

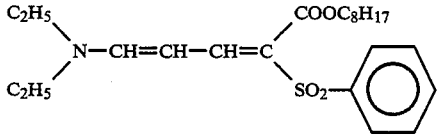

ExM-3

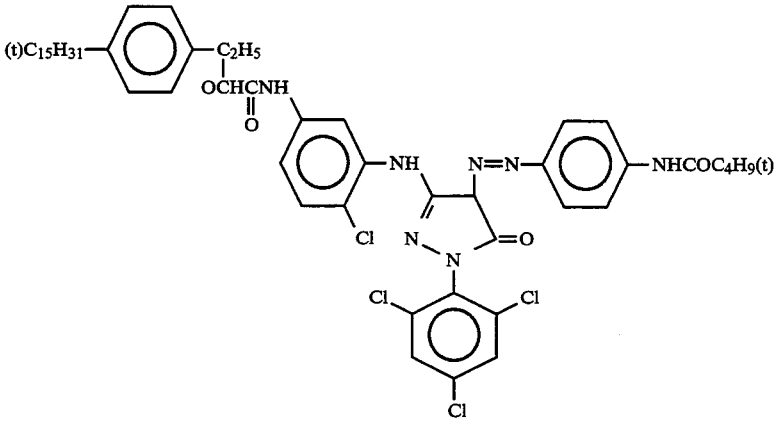

ExC-1

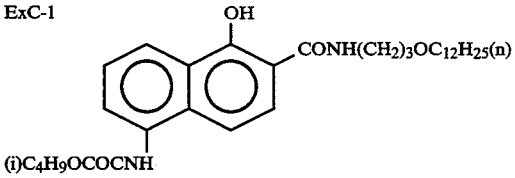

ExC-2

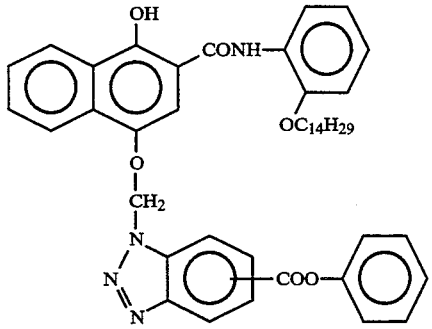

-continued
ExC-3
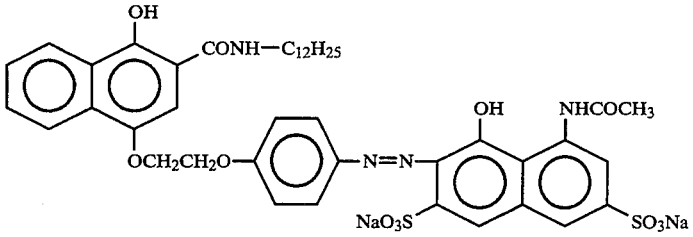
ExC-6
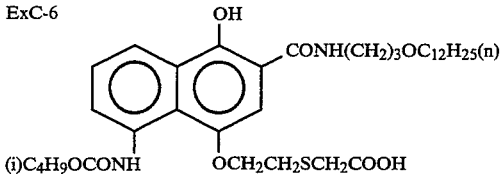
ExC-7
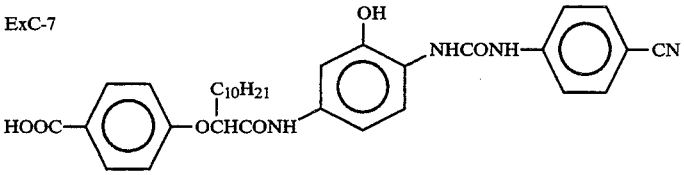
ExC-4
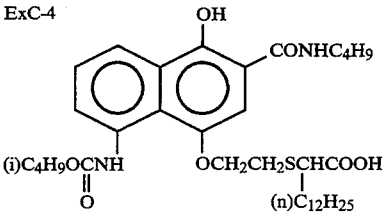
ExC-5
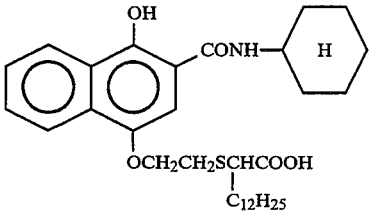
ExM-1
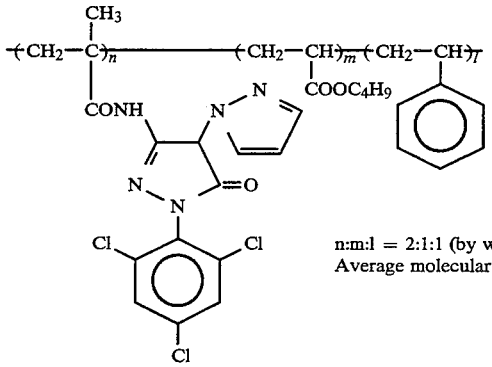
n:m:l = 2:1:1 (by weight)
Average molecular weight: 40,000
ExM-2
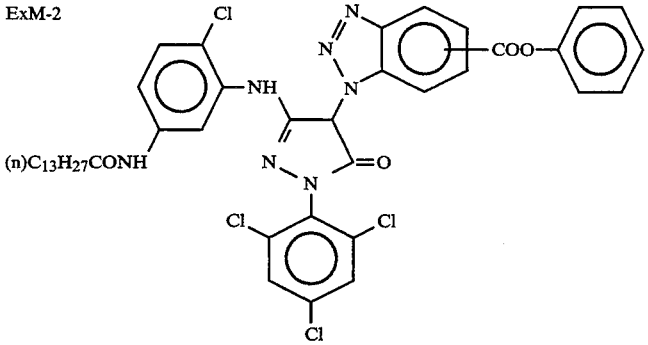

-continued
ExM-4
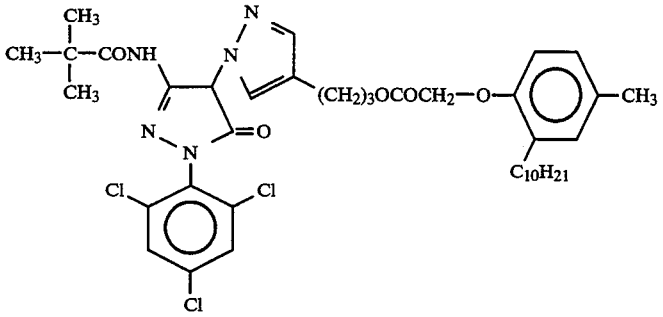
ExM-5
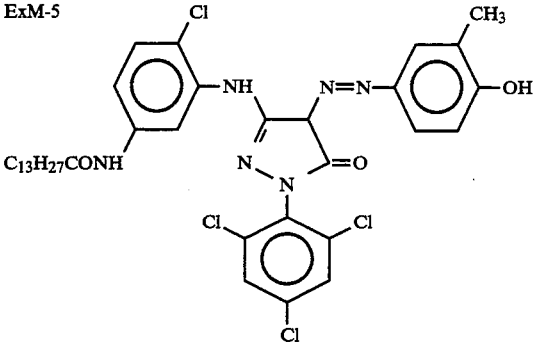
ExM-6
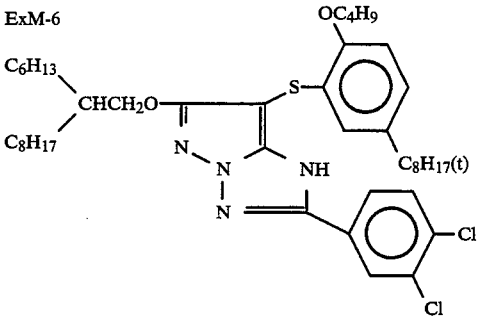
ExY-1
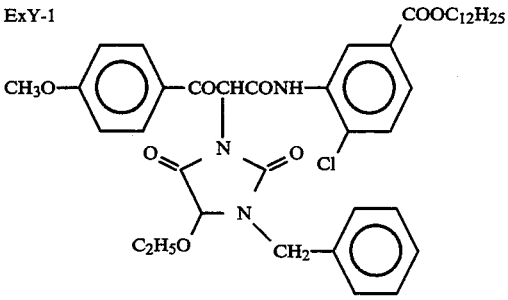
ExY-2
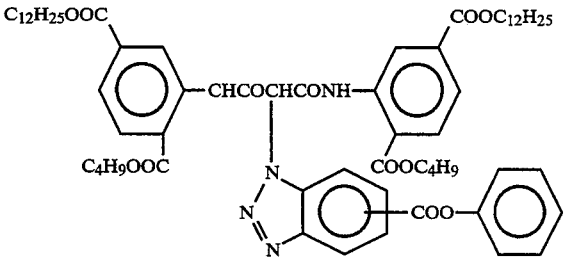
ExY-3
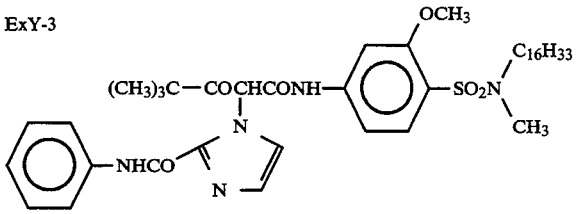
ExS-1
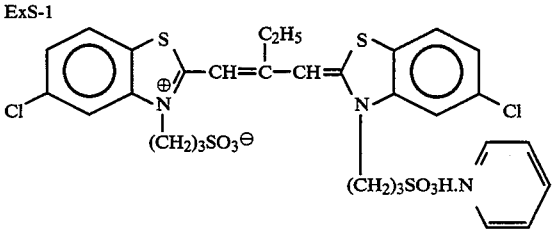
ExS-2
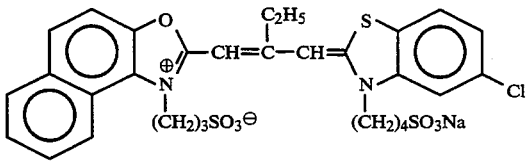
ExS-3
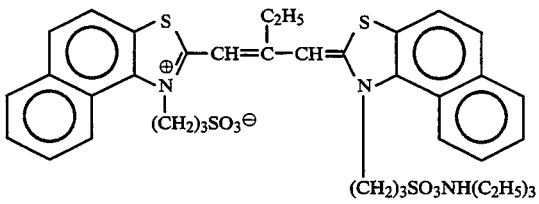
ExS-4
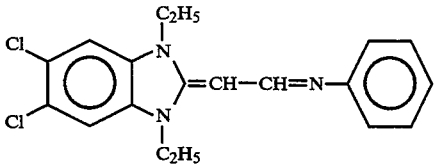

-continued
ExS-5
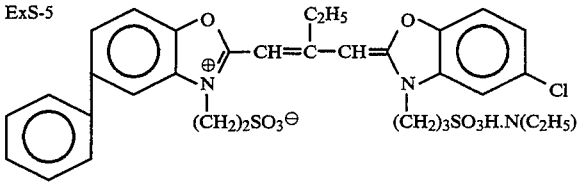
ExS-6
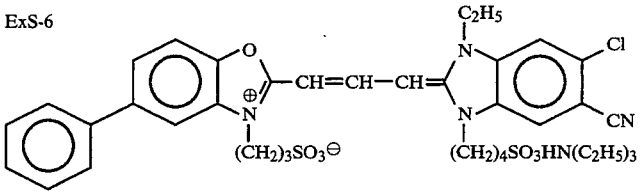
ExS-8
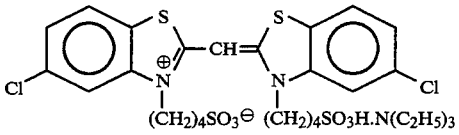
ExS-7
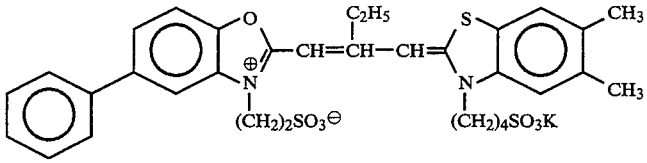
Solv-1
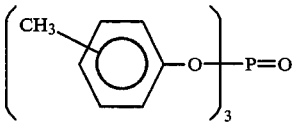
Solv-2
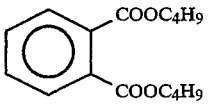
Solv-3
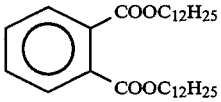
Solv-4
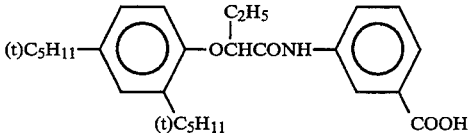
Cpd-1
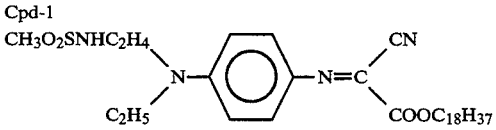
Cpd-2
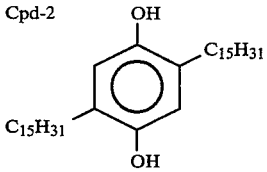
Cpd-3
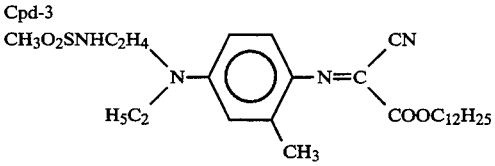
Cpd-4
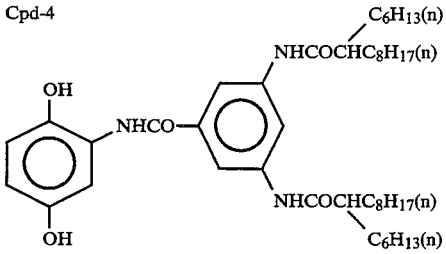

-continued

Cpd-5

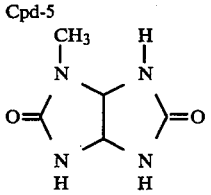

W-1

$C_8F_{17}SO_2NHCH_2CH_2CH_2OCH_2CH_2\overset{\oplus}{N}(CH_3)_3$

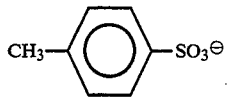

H-1

$CH_3{=}CHSO_2CH_2CONH{-}CH_2$ $CH_3{=}CHSO_2CH_2CONH{-}CH_2$

The specimen thus prepared was cut into 35 mm wide strips, worked, wedgewise exposed to white light (color temperature of light source: 4,800° K.), and then processed by means of a processing machine for motion picture in the following process. For the evaluation of properties, another bath of the specimen which had been imagewise exposed to light was processed until the accumulated replenishment rate of the color developer reached three times the capacity of the running tank.

The composition and pH value of the bleaching solution used in the processing step were as set forth in Table 1. For the aeration of the bleaching solution, the bleaching bath was provided at the bottom thereof with a pipe having a large number of pores having a diameter of 0.2 mm through which air was supplied at a rate of 200 ml/minute.

| Processing step | | | | |
|---|---|---|---|---|
| Step | Time | Temperature | Replenishment rate | Tank capacity |
| Color development | 3 min. 15 sec. | 37.8° C. | 23 ml | 10 l |
| Bleaching | 50 sec. | 38.0° C. | 5 ml | 5 l |
| Fixing | 1 min. 40 sec. | 38.0° C. | 30 ml | 10 l |
| Washing (1) | 30 sec. | 38.0° C. | — | 5 l |
| Washing (2) | 20 sec. | 38.0° C. | 30 ml | 5 l |
| Stabilization | 20 sec. | 38.0° C. | 20 ml | 5 l |
| Drying | 1 min. | 55° C. | — | — |

*Determined per 35 mm width and 1 m length

The washing step was effected in a countercurrent process wherein the washing water flows backward. The amount of the developer brought over to the bleaching step, and the amount of the fixing solution brought over to the washing step were 2.5 ml, and 2.0 ml per m of 35 mm wide light-sensitive material, respectively.

The time for crossover was 5 seconds in all the steps. This crossover time is included in the processing time at the previous step.

The various processing solutions had the following compositions:

| | Tank solution | Replenisher |
|---|---|---|
| Developer | | |
| Diethylenetriamine-pentaacetic acid | 1.0 g | 1.0 g |
| 1-Hydroxyethylidene-1,1-diphosphonic acid | 3.0 g | 3.2 g |
| Sodium sulfite | 4.0 g | 4.9 g |
| Potassium carbonate | 30.0 g | 30.0 g |
| Potassium bromide | 1.4 g | — |
| Potassium iodide | 1.5 mg | — |
| Hydroxyamine sulfate | 2.4 g | 3.6 g |
| 4-[N-ethyl-N-(B-hydroxyethyl)-amino]-2-methylaniline sulfate | 4.5 g | 6.4 g |
| Water to make | 1.0 l | 1.0 l |
| pH | 10.05 | 10.10 |
| Bleaching solution | | |

-continued

| | Tank solution | Replenisher |
|---|---|---|
| Bleaching agent as set forth in Table 1 | 0.50 mol | 0.55 mol |
| Chelating compound as set forth in Table 1 | 0.05 mol | 0.055 mol |
| Ammonium bromide | 190.0 g | 270 g |
| Ammonium nitrate | 90.0 g | 125.0 g |
| Water to make | 1.0 l | 1.0 l |
| pH | 6.0 | 6.0 |

The chelating compound used is an organic acid constituting a ferric ammonium salt of organic acid to be incorporated in the bleaching agent.

| Fixing solution | Tank solution | Replenisher |
|---|---|---|
| Diammonium ethylenediamine-tetraacetate | 1.7 g | Same as left |
| Ammonium sulfite | 14.0 g | " |
| Aqueous solution of ammonium thiosulfate (700 g/l) | 340.0 ml | " |
| Water to make | 1.0 l | " |

Washing solution (The tank solution was used also as replenisher)

Tap water was passed through a mixed bed column packed with an H-type strongly acidic cation exchange resin (Amberlite IR-120B manufactured by Rohm & Haas) and an OH-type strongly basic anion exchange resin (Amberlite IRA-400 manufactured by the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively. The washing solution thus obtained had a pH value of 6.5 to 7.5.

| Stabilizing solution (The tank solution was used also as replenisher) | |
|---|---|
| 37 wt % Formalin | 1.2 ml |
| Surface active agent $[C_{10}H_{21}{-}O{\leftarrow}CH_2CH_2O{-}H]_{10}$ | 0.4 g |
| Ethylene glycol | 1.0 g |
| Water to make | 1.0 l |
| pH | 5.0–7.0 |

The photographic light-sensitive material specimens thus processed were then measured with respect to the amount of residual silver at the maximum color density portion by means of a fluorescent X-ray analyzer. The results are set forth in Table 1.

These photographic light-sensitive material specimens were also measured for density. Dmin values measured by green light (G-light) were read from the characteristic curve.

Another bath of these specimens were processed with the following reference bleaching solution having no bleaching fog at a temperature of 38° C. at a replenishment rate of 25 ml/35 mm width and 1 m length for 390 seconds.

| Reference bleaching solution | Tank solution | Replenisher |
|---|---|---|
| Ferric sodium ethylenediamine-tetraacetate trihydrate | 100.0 g | 120.0 g |
| Disodium ethylenediamine-tetraacetate | 10.0 g | 11.0 g |
| Ammonium bromide | 140.0 g | 160.0 g |
| Ammonium nitrate | 30.0 g | 35.0 g |
| Aqueous ammonia (27 wt %) | 6.5 ml | 4.0 ml |
| Water to make | 1.0 l | 1.0 l |
| pH | 6.0 | 5.7 |

The specimens thus processed were measured for density in the same manner as described above. Dmix values were read from the characteristic curve.

The difference (ΔDmin) in Dmix of the specimens from that obtained by the reference bleaching solution were determined. Dmin value obtained by the reference bleaching solution was 0.60.

Bleaching fog (ΔDmin)=(Dmin of each specimen)−(Dmin obtained by standard bleaching solution)

The results are set forth in Table 1.

These specimens were also measured with respect to increase in stain during the storage after processing. For this measurement, these specimens were stored under a wet heat condition (60° C., 70% RH) in a dark place for 4 weeks. The change in Dmin on noncolored portion between before and after storage was determined.

Increae in stain (ΔD)=(Dmin after storage)−(Dmin before storage)

The results are set forth in Table 1.

TABLE 1

| No. | Organic acid for bleaching agent (ferric ammonium salt of organic acid) | Amount of residual silver [μg/cm²] | Bleaching fog ΔDmin (G) | Increase in stain ΔD (G) |
|---|---|---|---|---|
| 101 | Comparative Compound A | 14.8 | 0.00 | 0.35 |
| 102 | Comparative Compound B | 32.0 | 0.00 | 0.08 |
| 103 | Comparative Compound C | 21.0 | 0.00 | 0.10 |
| 104 | Comparative Compound D | 4.0 | 0.39 | 0.18 |
| 105 | Comparative Compound E | 5.2 | 0.01 | 0.21 |
| 106 | Present Compound 1 | 5.1 | 0.00 | 0.03 |
| 107 | Present Compound 2 | 5.0 | 0.00 | 0.04 |
| 108 | Present Compound 12 | 4.6 | 0.00 | 0.03 |
| 109 | Present Compound 20 | 4.3 | 0.00 | 0.03 |
| 110 | Present Compound 21 | 4.5 | 0.00 | 0.03 |

Comparative Compound A

-continued

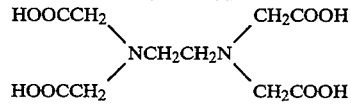

Comparative Compound B

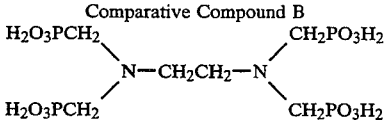

Comparative Compound C

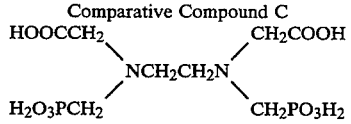

Comparative Compound D

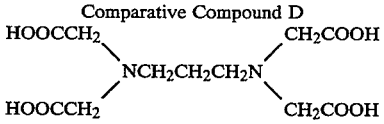

Comparative Compound E

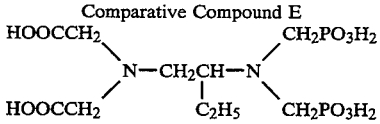

The results set forth in Table 1 show that as compared to the comparative compounds the present compounds are capable of reducing the amount of residual silver while contributing to eliminating stain during the storage of dye images after processing,

EXAMPLE 2

A multilayer color light-sensitive material was prepared as Specimen 201 by coating on a undercoated cellulose triacetate film support various layers having the following compositions, Composition of light-sensitive layer The coated amount of each component is represented in g/m². The coated amount of silver halide is represented in g/m² as calculated in terms of amount of silver. The coated amount of sensitizing dye is represented in mol per mol of silver halide contained in the same layer.

| (Specimen 201) | |
|---|---|
| 1st Layer: anti-halation layer | |
| Black colloidal silver | 0.18 |
| Gelatin | 1.00 |
| 2nd Layer: interlayer | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 0.90 |
| 3rd layer: 1st red-sensitive emulsion layer | |
| Emulsion A | 0.25 (as silver) |
| Emulsion B | 0.25 (as silver) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.160 |

-continued (Specimen 201)

| | |
|---|---|
| EX-14 | 0.185 |
| EX-10 | 0.020 |
| HBS-1 | 0.060 |
| Gelatin | 0.80 |
| 4th Layer: 2nd red-sensitive emulsion layer | |
| Emulsion G | 1.0 (as silver) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.200 |
| EX-14 | 0.210 |
| EX-3 | 0.050 |
| HBS-1 | 0.060 |
| Gelatin | 1.20 |
| 5th Layer: 3rd red-sensitive emulsion layer | |
| Emulsion D | 1.60 (as silver) |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.53 |
| 6th Layer: interlayer | |
| EX-5 | 0.040 |
| HBS-1 | 0.020 |
| Gelatin | 0.60 |
| Cpd-4 | 0.1 |
| 7th Layer: 1st green-sensitive emulsion layer | |
| Emulsion A | 0.15 (as silver) |
| Emulsion B | 0.15 (as silver) |
| Sensitizing dye V | $3.0 \times 10^{-5}$ |
| Sensitizing dye VI | $1.0 \times 10^{-5}$ |
| Sensitizing dye VII | $3.8 \times 10^{-4}$ |
| EX-6 | 0.120 |
| EX-15 | 0.145 |
| EX-1 | 0.021 |
| EX-7 | 0.030 |
| EX-8 | 0.025 |
| HBS-1 | 0.100 |
| HBS-3 | 0.010 |
| Gelatin | 0.63 |
| 8th Layer: 2nd green-sensitive emulsion layer | |
| Emulsion C | 0.45 (as silver) |
| Sensitizing dye V | $2.1 \times 10^{-5}$ |
| Sensitizing dye VI | $7.0 \times 10^{-5}$ |
| Sensitizing dye VI | $2.6 \times 10^{-4}$ |
| EX-6 | 0.047 |
| EX-15 | 0.047 |
| EX-8 | 0.018 |
| EX-7 | 0.026 |
| HBS-1 | 0.160 |
| HBS-3 | 0.008 |
| Gelatin | 0.50 |
| 9th Layer: 3rd green-sensitive emulsion layer | |

-continued (Specimen 201)

| | |
|---|---|
| Emulsion E | 1.2 (as silver) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.40 |
| 10th Layer: Yellow filter layer | |
| Yellow colloidal silver | 0.05 (as silver) |
| EX-5 | 0.08 |
| HBS-1 | 0.03 |
| Gelatin | 0.95 |
| 11th Layer: 1st blue-sensitive emulsion layer | |
| Emulsion A | 0.08 (as silver) |
| Emulsion B | 0.07 (as silver) |
| Emulsion F | 0.07 (as silver) |
| Sensitizing dye VIII | $3.5 \times 10^{-4}$ |
| EX-9 | 0.350 |
| EX-16 | 0.400 |
| EX-8 | 0.042 |
| HBS-1 | 0.28 |
| Gelatin | 1.10 |
| 12th Layer: 2nd blue-sensitive emulsion layer | |
| Emulsion G | 0.45 (as silver) |
| Sensitizing dye VIII | $2.1 \times 10^{-4}$ |
| EX-9 | 0.070 |
| EX-16 | 0.093 |
| EX-10 | 0.007 |
| HBS-1 | 0.05 |
| Gelatin | 0.70 |
| 13th Layer: 3rd blue-sensitive layer | |
| Emulsion H | 0.77 (as silver) |
| Sensitizing dye VIII | $2.2 \times 10^{-4}$ |
| EX-9 | 0.20 |
| HBS-1 | 0.07 |
| Gelatin | 0.69 |
| 14th Layer: 1st protective layer | |
| Emulsion I | 0.5 (as silver) |
| U-4 | 0.11 |
| U-5 | 0.17 |
| HBS-1 | 0.05 |
| Gelatin | 0.80 |
| 15th Layer: 2nd protective layer | |
| Polymethyl acrylate grains (diameter: about 1.5 um) | 0.54 |
| S-1 | 0.20 |
| Gelatin | 1.10 |

In addition to the above mentioned components, a gelatin hardener H-1 and a surface active agent were incorporated in each of these layers.

| | Mean AgI content (wt %) | Mean grain diameter (μm) | Grain diameter fluctuation coefficient (wt %) | Diameter/ thickness ratio | Ratio of amount of (wt % AgI content) |
|---|---|---|---|---|---|
| Emulsion A | 4.1 | 0.45 | 27 | 1 | Core/shell = 1/3 (13/1), double structure grain |
| Emulsion B | 8.9 | 0.70 | 14 | 1 | Core/shell = 3/7 25/2), double structure grain |
| Emulsion C | 10 | 0.75 | 30 | 2 | Core/shell = 1/2 (24/3), double |

-continued

| | Mean AgI content (wt %) | Mean grain diameter (μm) | Grain diameter fluctuation coefficient (wt %) | Diameter/ thickness ratio | Ratio of amount of (wt % AgI content) |
|---|---|---|---|---|---|
| Emulsion D | 16 | 1.05 | 35 | 2 | structure grain Core/shell = 1/2 (40/0), double structure grain |
| Emulsion E | 10 | 1.05 | 35 | 3 | Core/shell = 1/2 (24/3), double structure grain |
| Emulsion F | 4.1 | 0.25 | 28 | 1 | Core/shell = 1/3 13/1), double structure grain |
| Emulsion G | 13.6 | 0.75 | 25 | 2 | Core/shell = 1/2 (40/0), double structure grain |
| Emulsion H | 14 | 1.30 | 25 | 3 | Core/shell = 37/63 (34/3), double structure grain |
| Emulsion I | 1 | 0.07 | 15 | 1 | Uniform grain |

EX-1

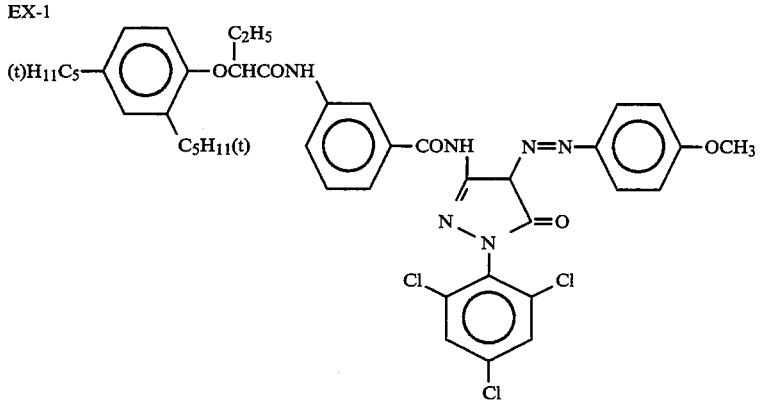

EX-2

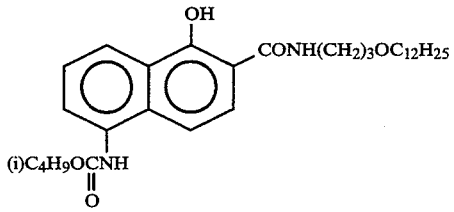

EX-3

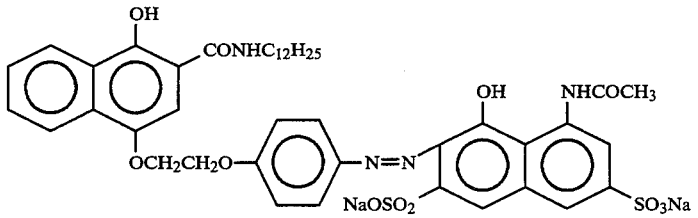

EX-4

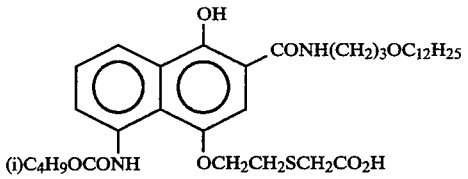

EX-5

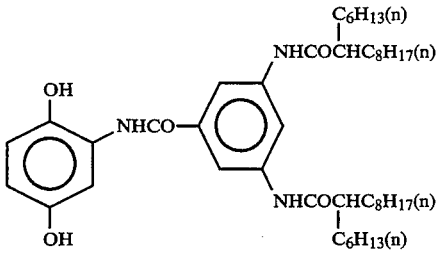

-continued
EX-6
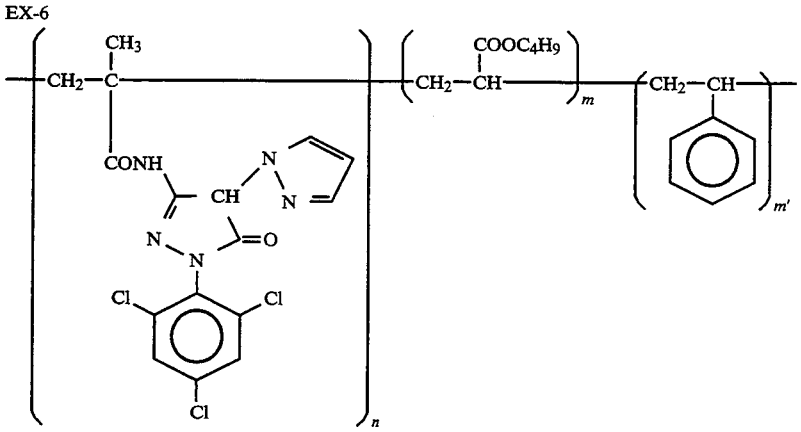
n = 50
m = 25
m' = 25
Molar weight: approx. 20,000
EX-7
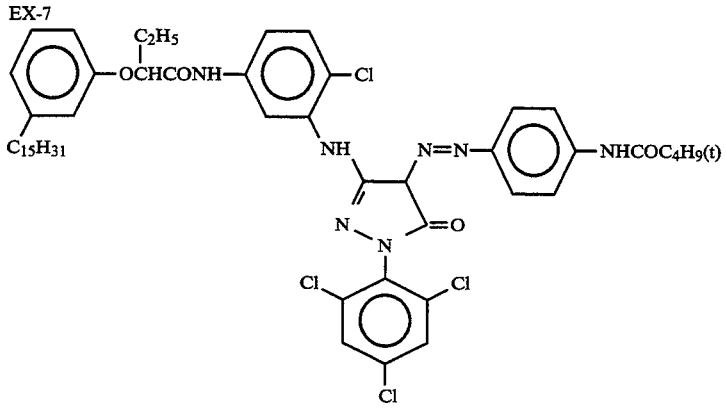
EX-8
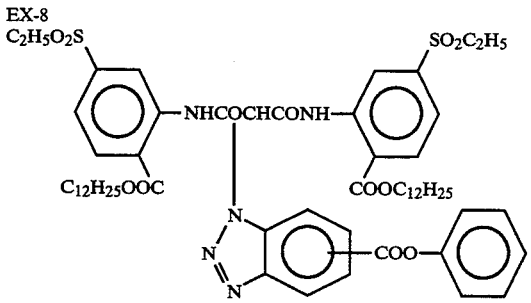
EX-9
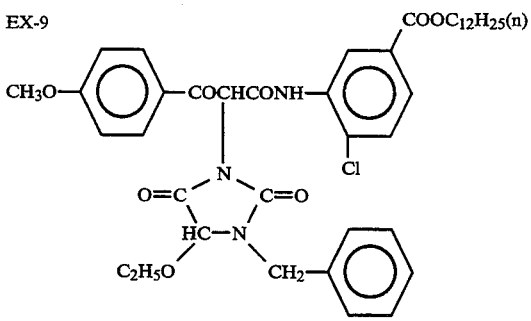

-continued
EX-10
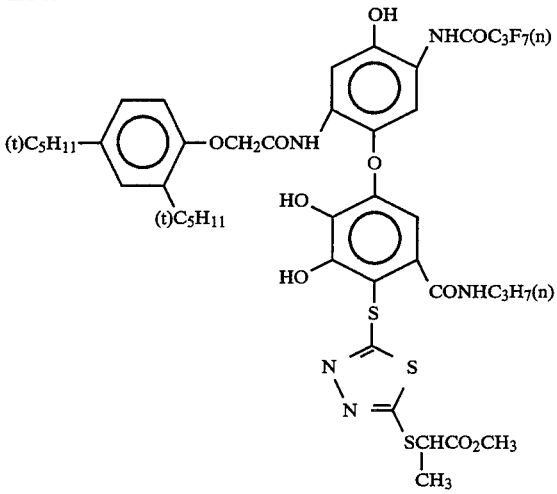
EX-11
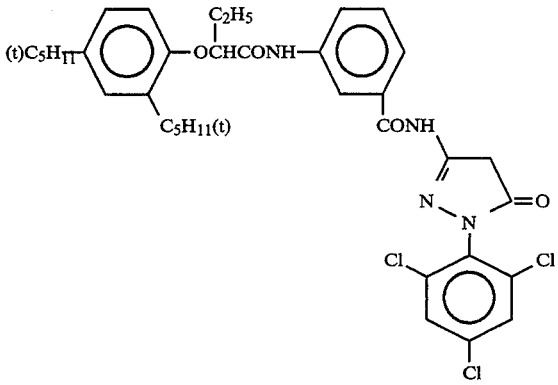
EX-12
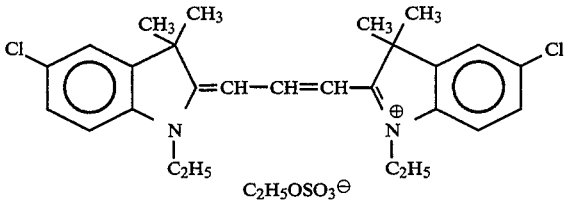
EX-13
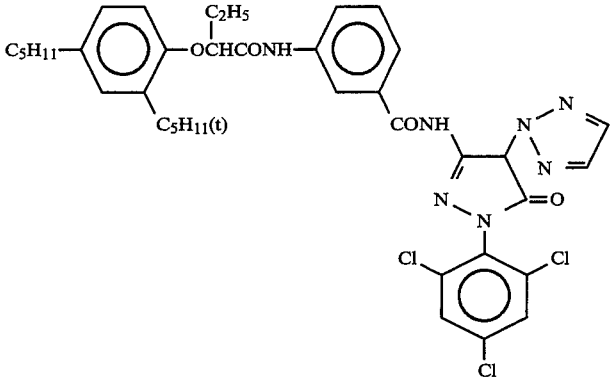
EX-14
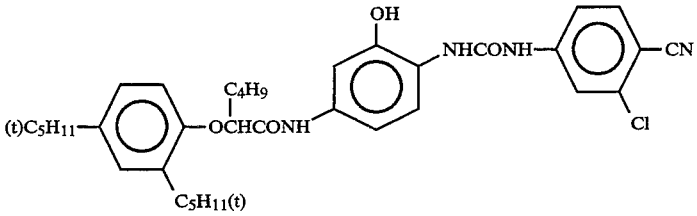
EX-15
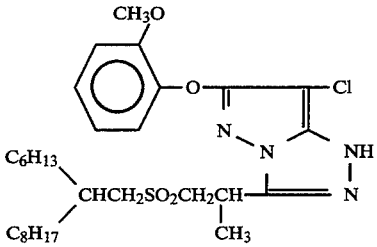
EX-16
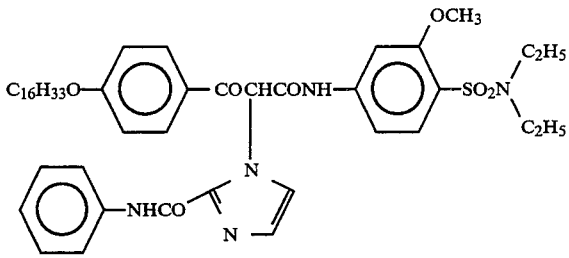

-continued
U-1
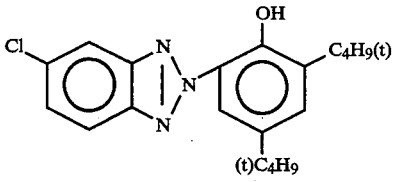
U-2
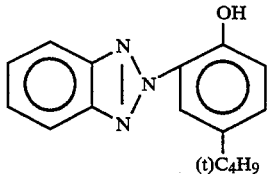
U-3
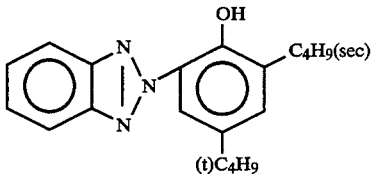
U-4
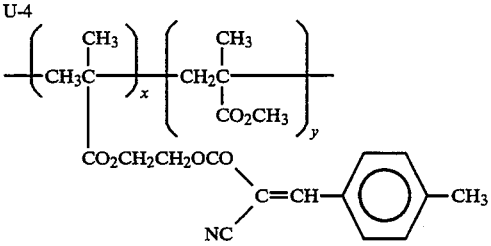
x:y = 70:30 (wt %)
UV-5
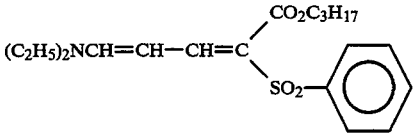
HBS-1 Tricresyl phosphate
HBS-2: Di-n-butyl phthalate
HBS-3
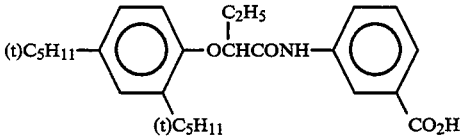
Sensitizing Dye I
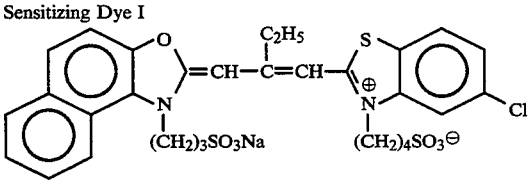
Sensitizing Dye II
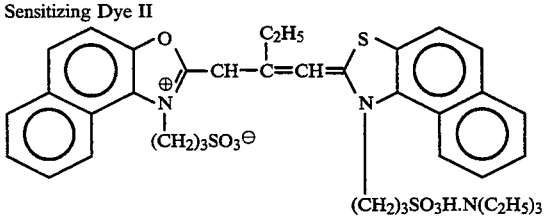
Sensitizing Dye III
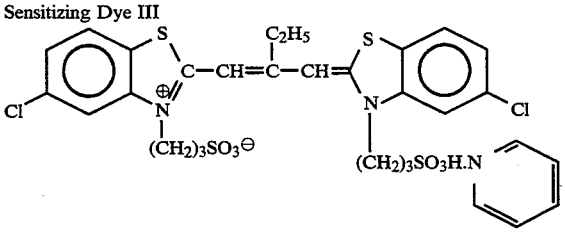
Sensitizing Dye V
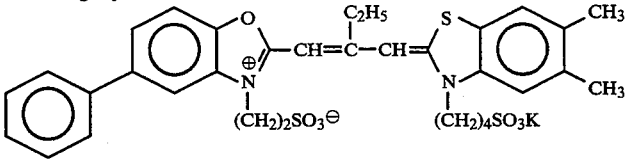
Sensitizing Dye VI
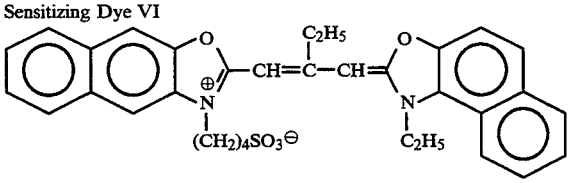

-continued

Sensitizing Dye VII

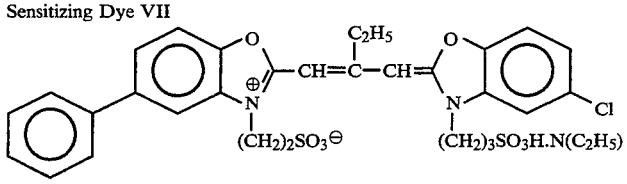

Sensitizing Dye VIII

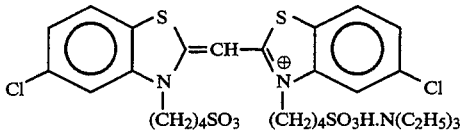

S-1

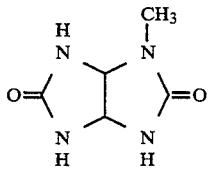

H-1

$CH_2{=}CH{-}SO_2{-}CH_2{-}CONH{-}CH_2$ $CH_2{=}CH{-}SO_2{-}CH_2{-}CONH{-}CH_2$

The light-sensitive material specimen thus prepared was then processed in the following manner:

| Step | Processing step Time | Temperature | Replenishment rate | Tank capacity |
|---|---|---|---|---|
| Color development | 3 min. 5 sec. | 38° C. | 25 ml | 10 l |
| Bleaching | 40 sec. | 38° C. | 5 ml | 4 l |
| Blixing | 40 sec. | 38° C. | — | 4 l |
| Fixing | 40 sec. | 38° C. | 16 ml | 4 l |
| Washing (1) | 30 sec. | 38° C. | — | 2 l |
| Washing (2) | 20 sec | 38° C. | 30 ml | 2 l |
| Stabilization | 20 sec. | 38° C. | 20 ml | 2 l |
| Drying | 1 min. | 55° C. | — | — |

*Determined per 35-mm width and 1-m length

The washing step was effected in a counter-current process wherein the washing water flows backward. The overflow solution from the bleaching bath was all introduced into the blixing bath.

Furthermore, the overflow solution from the washing tank (1) was all introduced into the fixing bath, and the overflow solution from the fixing bath was all introduced into the blixing bath.

The amount of the fixing solution brought over to the washing step was 2.0 ml per m of a 35 mm wide light-sensitive material.

Developer

Same as color developer used in Example 1

| | Tank solution | Replenisher |
|---|---|---|
| Bleaching solution | | |
| Bleaching agent as set forth in Table 2 | 0.4 mol | 0.55 mol |
| Ammonium bromide | 190 g | 270 g |
| Ammonium nitrate | 17.5 g | 25.0 g |
| Water to make | 1.0 l | 1.0 l |
| pH | 6.0 | 6.0 |
| Fixing solution | | |
| Aqueous solution of ammonium thiosulfate (700 g/l) | 280 ml | 840 ml |
| Ethylenediaminetetraacetic acid | 12.6 g | 38 g |
| Ammonium sulfite | 27.5 g | 82.5 g |
| Water to make | 1 l | 1 l |
| pH | 7.8 | 8.0 |

Blixing solution

5:16:30 (by volume) mixture of bleaching solution, fixing solution and washing solution Washing solution Same as washing solution used in Example 1

| Stabilizing solution | |
|---|---|
| 37 wt % Formalin | 2.0 ml |
| Polyoxyethylene-p-monononyl-phenylether (mean polymerization degree: 10) | 0.3 g |
| Disodium ethylenediamine-tetraacetate | 0.05 g |
| Water to make | 1.0 l |
| pH | 5.0–8.0 |

Another bath of these specimens were processed after the running process in the same manner as described above except that the content of ammonium bromide in the bleaching solution was altered as set forth in Table 2. The specimens thus processed were measured with respect to density in the same manner as described above. Dmix values measured by green light were read from the characteristic curve.

On the other hand, Specimen 201 was processed with the same standard bleaching solution as used in Example 1, and then measured for Dmin in the same manner as described above. Bleaching fog and Dmin were calculated on the basis of the Dmin value of the standard bleaching solution in the same manner as used in Example 1. The standard bleaching solution had a Dmix value of 0.57. The results are set forth in Table 2.

Another batch of the specimens thus processed were evaluated for stain during the storage of dye images after processing in the same manner as in Example 1. The results are set forth in Table 2.

Another batch of these specimens were exposed to light in such a manner that the grey density thus developed reached 1.5, processed in the same manner as described above, and then measured for the amount of residual silver by fluorescent X-ray process. The results are set forth in Table 2.

TABLE 2

| No. | Organic acid for bleaching agent (ferric ammonium salt of organic acid) | Content of ammonium bromide (g/l) | Amount of residual silver [μg/cm²] | ΔDim | ΔD |
|---|---|---|---|---|---|
| 201 | Comparative Compound A | 190 | 18.4 | 0.00 | 0.30 |
| 202 | Comparative Compound A | 150 | 21.0 | 0.00 | 0.28 |
| 203 | Comparative Compound B | 190 | 29.9 | 0.01 | 0.09 |
| 204 | Comparative | 190 | 26.1 | 0.06 | 0.11 |

TABLE 2-continued

| No. | Organic acid for bleaching agent (ferric ammonium salt of organic acid) | Content of ammonium bromide (g/l) | Amount of residual silver [μg/cm²] | ΔDim | ΔD |
|---|---|---|---|---|---|
| | Compound C | | | | |
| 205 | Comparative Compound D | 190 | 1.5 | 0.25 | 0.12 |
| 206 | Comparative Compound E | 190 | 4.6 | 0.03 | 0.22 |
| 207 | Present Compound 1 | 190 | 3.0 | 0.00 | 0.01 |
| 208 | Present Compound 1 | 150 | 3.8 | 0.00 | 0.04 |
| 209 | Present Compound 2 | 190 | 2.9 | 0.00 | 0.04 |
| 210 | Present Compound 12 | 190 | 2.6 | 0.00 | 0.02 |
| 211 | Present Compound 20 | 190 | 2.0 | 0.00 | 0.01 |
| 212 | Present Compound 20 | 150 | 3.0 | 0.01 | 0.03 |
| 213 | Present Compound 21 | 190 | 2.2 | 0.00 | 0.01 |
| 214 | Present Compound 21 | 150 | 3.1 | 0.01 | 0.03 |

Comparative Compounds A, B, C, D and E used were as used in Example 1.

Table 2 shows that the use of the present compounds enables further improvements in desilvering property and elimination of stain when the added amount of ammonium bromide is great while the use of Comparative Compound A provides some improvement in desilvering property but some deterioration in elimination of stain when the added amount of ammonium is increased.

These facts show that the use of the present compounds and the use of ammonium bromide in an amount of more than a predetermined value enables a rapid and excellent desilvering process which can eliminate stain and causes no bleach fogging.

EXAMPLE 3

A multilayer color photographic paper specimen was prepared by coating on a polyethylene double-laminated paper support various layers having the following compositions. The coating solutions for these layers were prepared as follows:

Coating solution for 1st layer 19.1 g of a yellow coupler (ExY), 4.4 g of a dye stabilizer (Cpd-1) and 0.7 g of a dye stabilizer (Cpd-7) were dissolved in 27.2 ml of ethyl acetate and 8.2 g of a solvent (Solv-1). The solution thus obtained was then emulsion-dispersed in 185 ml of a 10% aqueous solution of gelatin containing 8 ml of 10% sodium dodecyl-benzensulfonate (Emulsion Dispersion A). On the other hand, a silver bromochloride emulsion A (3:7 mixture (ratio of molar amount of silver) of a large size emulsion A of cubic grains with a mean grain size of 0.88 μm and a grain size distribution fluctuation coefficient of 0.08 and a small size emulsion A of cubic grains with a mean grain size of 0.70 μm and a grain size distribution fluctuation coefficient of 0.10, both having 0.2 mol % silver bromide localized on the surface thereof) was prepared by incorporating the blue-sensitive sensitizing dyes A and B as described later in amounts of $2.0\times10^{-4}$ mol and $2.5\times10^{-4}$ mol based on mol of silver in the large size emulsion A and the small size emulsion B, respectively, and then subjecting the material to sulfur sensitization. Emulsion Dispersion A and Silver Bromochloride Emulsion A were then mixed and dissolved to prepare a coating solution for the 1st layer having the following composition.

Coating solutions for the 2nd to 7th layers were prepared in the same manner as in the 1st layer coating solution. There was incorporated in each layer a sodium salt of 1-oxy-3,5-dichloro-s-triazine.

In the silver bromochloride emulsion for each light-sensitive emulsion layer were incorporated the following spectral sensitizing dyes:

Sensitizing dye A for blue-sensitive emulsion layer

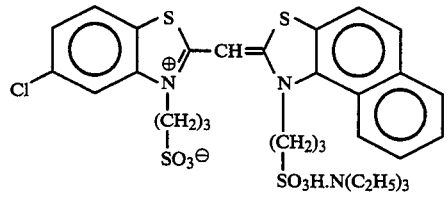

Sensitizing dye B for blue-sensitive emulsion layer

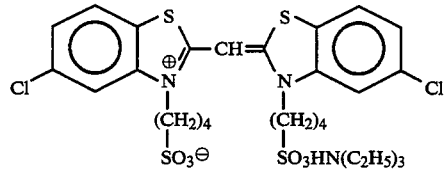

($2.0\times10^{-4}$ mol per mol of silver halide in the large size emulsion A and $2.5\times10^{-4}$ mol per mol of silver halide in the small size emulsion A)

Sensitizing dye C for green-sensitive emulsion layer

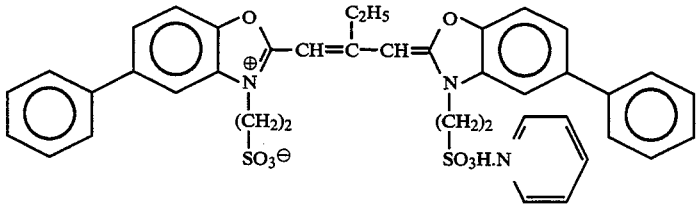

($4.0\times10^{-4}$ mol per mol of silver halide in the large size emulsion B and $5.6\times10^{-4}$ mol per mol of silver halide in the small size emulsion B)

Sensitizing dye D for green-sensitive emulsion layer

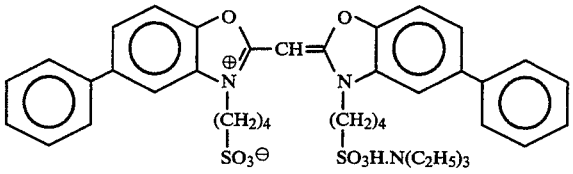

($7.0\times10^{-5}$ mol per mol of silver halide in the large size emulsion B and $1.0\times10^{-5}$ mol per mol of silver halide in the small size emulsion B)

Sensitizing dye E for red-sensitive emulsion layer

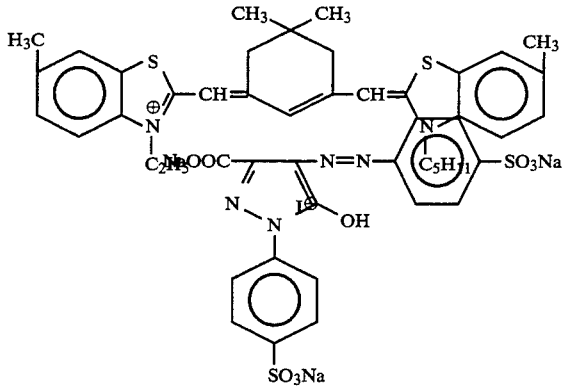

($0.9\times10^{-4}$ mol per mol of silver halide in the large size emulsion C and $1.1\times10^{-4}$ mol per mol of silver halide in the small size emulsion C)

In the red-sensitive emulsion layer was incorporated the following compound in an amount of $2.6\times10^{-3}$ mol per mol of silver halide:

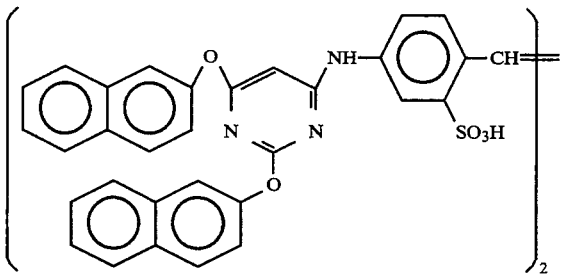

In the blue-sensitive emulsion layer, the green-sensitive emulsion layer and the red-sensitive emulsion layer was incorporated 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide.

In the blue-sensitive emulsion layer and the green-sensitive emulsion layer was incorporated 4-hydroxy-6-methyl-1,3,3a,7-tetrazaindene in amounts of $1\times10^{-4}$ mol and $2\times10^{-4}$ mol per mol of silver halide.

In order to inhibit irradiation, the following dyes were incorporated in these emulsion layers.

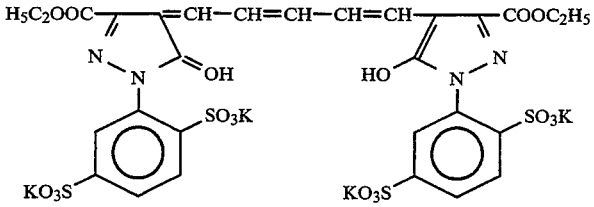

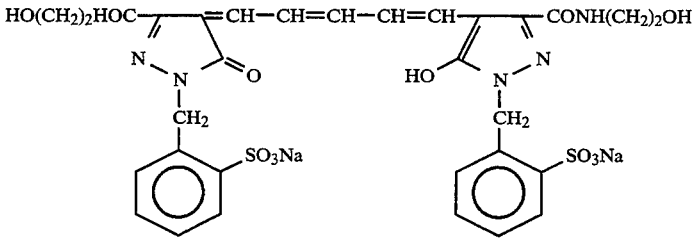

(Layer structure)

The composition of these layers will be set forth below. The figure indicate coated amount in g/m$^2$. The coated amount of silver halide emulsion is represented as calculated in terms of amount of silver.

Support

Polyethylene-laminated paper [containing a white pigment ($TiO_2$) and a bluish dye (ultramarine) on the 1st layer side]

| | |
|---|---|
| 1st layer: blue-sensitive emulsion layer | |
| Silver bromochloride emulsion A as set forth above | 0.30 |
| Gelatin | 1.86 |
| Yellow coupler (ExY) | 0.82 |
| Dye stabilizer (Cpd-1) | 0.19 |
| Solvent (Solv-1) | 0.35 |
| Dye stabilizer (Cpd-7) | 0.06 |
| 2nd layer: color stain inhibiting layer | |
| Gelatin | 0.99 |
| Color stain inhibiting agent (Cpd-5) | 0.08 |
| Solvent (Solv-1) | 0.16 |
| Solvent (Solv-4) | 0.08 |
| 3rd layer: green-sensitive emulsion layer | |
| Silver bromochloride emulsion (1:3 mixture (ratio of molar amount of silver) of a large size emulsion B of cubic grains with a mean grain size of 0.55 μm and | 0.12 |

-continued

| | |
|---|---|
| a grain size distribution fluctuation coefficient of 0.10 and a small size emulsion B of cubic grains with a mean grain size of 0.39 μm and a grain size distribution fluctuation coefficient of 0.08, both having 0.8 mol % silver bromide localized on the surface thereof) | |
| Gelatin | 1.24 |
| Magenta coupler (ExM) | 0.20 |
| Dye stabilizer (Cpd-2) | 0.03 |
| Dye stabilizer (Cpd-3) | 0.15 |
| Dye stabilizer (Cpd-4) | 0.02 |
| Dye stabilizer (Cpd-9) | 0.02 |
| Solvent (Solv-2) | 0.40 |
| 4th layer: ultraviolet-absorbing layer | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| 5th layer: red-sensitive emulsion layer | |
| Silver bromochloride emulsion (1:4 mixture (ratio of molar amount of silver) of a large size emulsion C of cubic grains with a mean grain size of 0.58 μm and a grain size distribution fluctuation coefficient of 0.09 and a small size emulsion C of cubic grains with a mean grain size of 0.45 μm and a grain size distribution fluctuation coefficient of 0.11, both having 0.6 mol % silver bromide localized on the surface thereof) | 0.23 |
| Gelatin | 1.34 |
| Cyan coupler (ExC) | 0.32 |
| Dye stabilizer (Cpd-6) | 0.17 |
| Dye stabilizer (Cpd-7) | 0.40 |
| Dye stabilizer (Cpd-8) | 0.04 |
| Solvent (Solv-6) | 0.15 |
| 6th layer: ultraviolet-absorbing layer | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| 7th layer: protective layer | |
| Gelatin | 1.33 |
| Acryl-modified copolymer of polyvinyl alcohol (modification degree: 17%) | 0.17 |
| Liquid paraffin | 0.03 |

Yellow Coupler (ExY):
1:1 Mixture (molar ratio) of

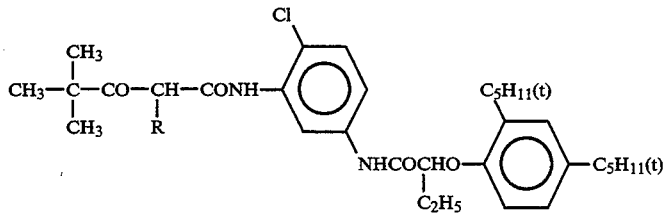

wherein R = 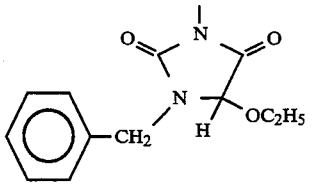 and R = 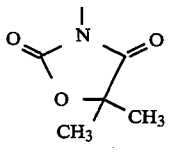

Magenta coupler (ExM)
1:1 Mixture (molar ratio) of

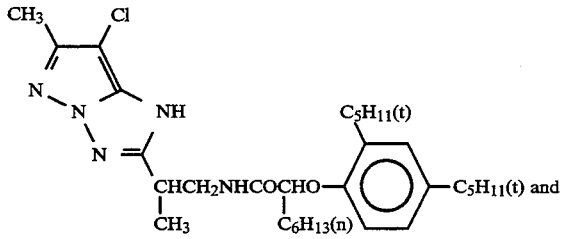

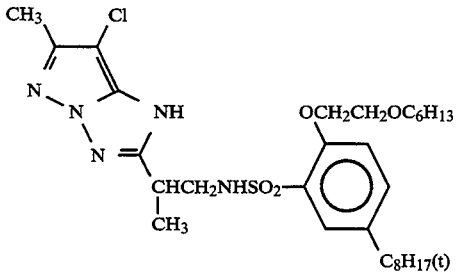

Cyan coupler (ExC)
2:4:4 Mixture (molar ratio) of

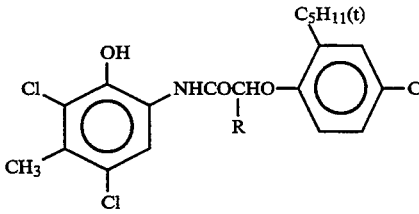

wherein R = $C_2H_5$ and $C_4H_9$ and

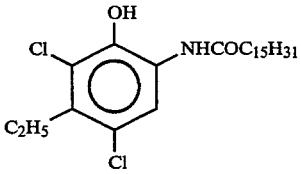

-continued
Dye stabilizer (Cpd-1)
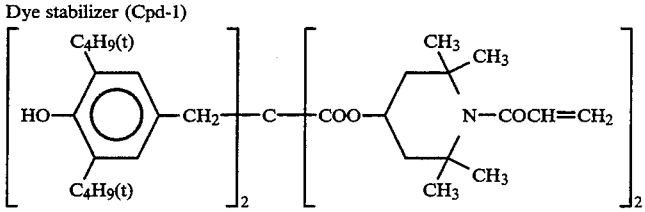
Dye stabilizer (Cpd-2)
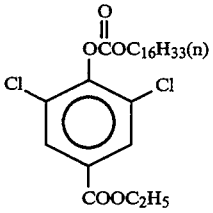
Dye stabilizer (Cpd-3)
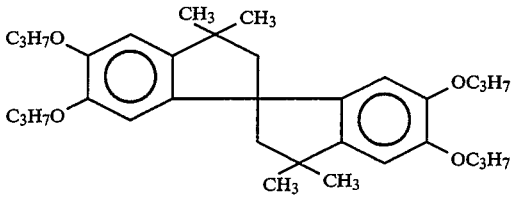
Dye stabilizer (Cpd-4)
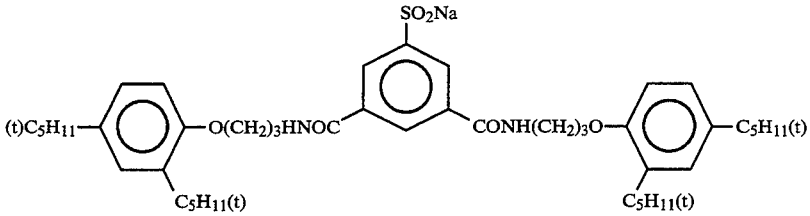
Color stain inhibitor (Cpd-5)
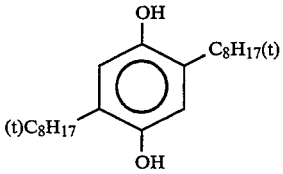
Color stain inhibitor (Cpd-6)
2:4:4 Mixture (weight ratio) of
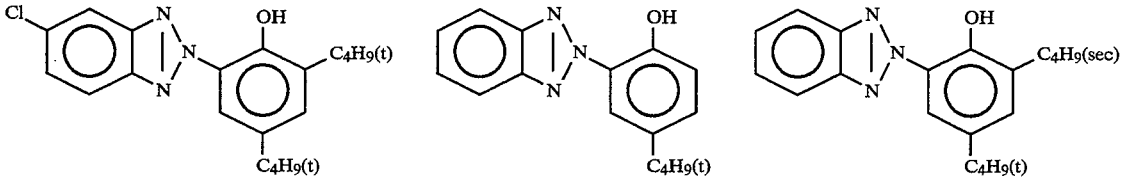
Dye stabilizer (Cpd-7)
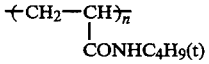
Mean molecular weight: 60,000)
Dye stabilizer (Cpd-8)
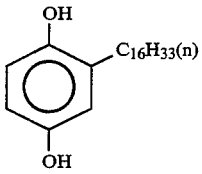
Dye stabilizer (Cpd-9)
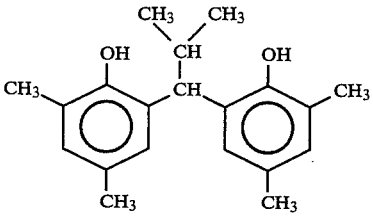
Ultraviolet Absorbent (UV-1)
4:2:4 Mixture (weight ratio) of
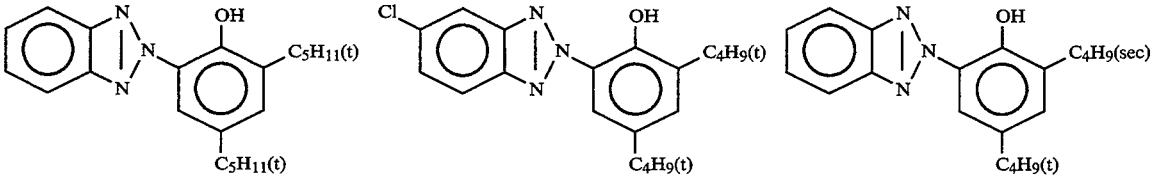
Solvent (Solv-1)
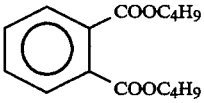
Solvent (Solv-2)
2:1 Mixture (by volume) of
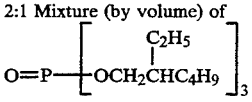
and
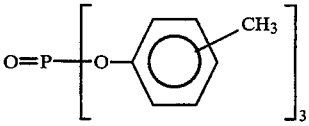

-continued

Solvent (Solv-4)

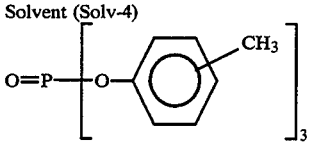

Solvent (Solv-5)

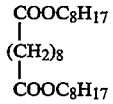

Solvent (Solv-6)

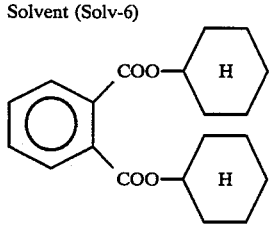

Various processing solutions having the following compositions were prepared:

| | |
|---|---|
| Color developer | |
| Water | 600 ml |
| Ethylenediamine-N,N,N',N'-tetramethylenephosphonic acid | 2.0 g |
| Potassium bromide | 0.015 g |
| Potassium chloride | 3.1 g |
| Triethanolamine | 10.0 g |
| Potassium carbonate | 27 g |
| Fluorescent brightening agent (WHITEX.4B, manufactured by Sumitomo Chemical Co., Ltd.) | 1.0 g |
| Diethylhydroxylamine | 4.2 g |
| N-ethyl-N-(β-methanesulfonamidoethyl)-3-methyl-4-aminoaniline sulfate | 5.0 g |
| Water to make | 1,000 ml |
| pH (25° C) | 10.05 |
| Blixing solution | |
| Water | 400 ml |
| Ammonium thiosulfate (70 wt %) | 100 ml |
| Sodium sulfite | 17 g |
| Bleaching agent as set forth in Table 3 | 0.50 mol |
| Chelating compound as set forth in Table 3 | 0.05 mol |
| Ammonium bromide | 40 g |
| Water to make | 1,000 ml |
| pH (25° C.) | 6.0 |

Rinsing solution

Ion-exchanged water (calcium and magnesium concentrations: 3 ppm or less, respectively)

The above mentioned light-sensitive material specimens were processed in the following manner:

| Processinq step | Temperature | Time |
|---|---|---|
| Color development | 38° C. | 45 sec. |
| Blixing | 35° C. | 45 sec. |
| Rinsing 1 | 35° C. | 20 sec. |
| Rinsing 2 | 35° C. | 20 sec. |
| Rinsing 3 | 35° C. | 20 sec. |
| Drying | 80° C. | 60 sec. |

Another bath of these specimens was uniformly exposed to light in such a manner that the grey density thus developed reached 1.5, processed in the same manner as described above, and then measured for the amount of residual silver in the maximum density portion thereon by a fluorescent X-ray process. The results are set forth in Table 3.

TABLE 3

| No. | Organic acid for bleaching agent (ferric ammonium of organic acid) (μg/cm²) | Amount of residual silver |
|---|---|---|
| 301 | Comparative Compound C | 23.4 |
| 302 | Present Compound 2 | 5.1 |
| 303 | Present Compound 12 | 3.0 |
| 304 | Present Compound 20 | 2.6 |
| 305 | Present Compound 21 | 2.8 |

Comparative Compound C

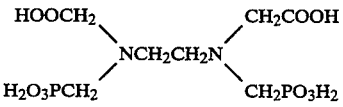

The results show that the use of the present compounds enables the reduction in the amount of residual silver as compared to Comparative Compound C.

The use of the present composition having a bleaching ability achieves a rapid processing having an excellent desilvering property which has no bleaching fog and little stain after processing.

EXAMPLE 4

The same procedure as in Example 1 was repeated except that the concentration of the bleaching agent and chelating agent in the tank solution of bleaching solution each was changed as shown in Table 4, provided that the concentration of the bleaching solution replenisher was 1.1 times the concentration shown in Table 4.

The thus-processed specimens were evaluated in the same manner as in Example 1.

Further, the evaluation of the process specimens which were obtained when a pH of the bleaching solution was changed to 3.0 and 7.0, respectively was also carried out.

TABLE 4

| No. | Organic acid for bleaching agent [ferric ammonium salt of organic acid] (Amount: mol) | | | Amount of Chelating Agent (mol) | PH of bleaching solution | Amount of residual silver [μg/cm²] | Breaching fog ΔDmin(G) | increase in Stain ΔD(G) | |
|---|---|---|---|---|---|---|---|---|---|
| 411 | Comparative Compound | A | (0.20) | 0.02 | 6.0 | 23.9 | 0.00 | 0.28 | Comparison |
| 412 | Comparative Compound | A | (0.70) | 0.07 | " | 11.4 | 0.02 | 0.36 | " |
| 413 | Comparative Compound | D | (0.20) | 0.02 | " | 9.2 | 0.27 | 0.14 | " |
| 414 | Comparative Compound | D | (0.70) | 0.07 | " | 3.8 | 0.50 | 0.20 | " |
| 415 | Present | 1 | (0.20) | 0.02 | " | 9.8 | 0.00 | 0.02 | Invention |

TABLE 4-continued

| No. | Organic acid for bleaching agent [ferric ammonium salt of organic acid] (Amount: mol) | | | Amount of Chelating Agent (mol) | PH of bleaching solution | Amount of residual silver [μg/cm²] | Breaching fog ΔDmin(G) | increase in Stain ΔD(G) | |
|---|---|---|---|---|---|---|---|---|---|
| 416 | Compound Present | 1 | (0.70) | 0.07 | " | 4.2 | 0.01 | 0.04 | " |
| 417 | Compound Present | 12 | (0.20) | 0.02 | " | 9.6 | 0.00 | 0.02 | " |
| 418 | Compound Present | 12 | (0.70) | 0.07 | " | 3.9 | 0.01 | 0.03 | " |
| 419 | Compound Comparative | A | (0.50) | 0.05 | 3.0 | 8.9 | 0.00 | 0.33 | Comparison |
| 420 | Compound Comparative | A | (0.50) | 0.05 | 7.0 | 17.9 | 0.02 | 0.36 | " |
| 421 | Compound Comparative | D | (0.50) | 0.05 | 3.0 | 3.9 | 0.22 | 0.16 | " |
| 422 | Compound Comparative | D | (0.50) | 0.05 | 7.0 | 5.2 | 0.48 | 0.20 | " |
| 423 | Compound Present | 1 | (0.50) | 0.05 | 3.0 | 4.6 | 0.00 | 0.03 | Invention |
| 424 | Compound Present | 1 | (0.50) | 0.05 | 7.0 | 5.4 | 0.00 | 0.04 | " |
| 425 | Compound Present | 12 | (0.50) | 0.05 | 3.0 | 4.2 | 0.00 | 0.03 | " |
| 426 | Compound Present | 12 | (0.50) | 0.05 | 7.0 | 5.2 | 0.01 | 0.04 | " |
| | Compound | | | | | | | | |

As is apparent from the results of Table 4, and the results of Example 1, the use of the metal chelate compound of the present invention can achieve a rapid processing having an excellent desilvering property which has no bleaching fog and little stain with the passage of time.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising color developing an imagewise exposed silver halide color photographic material and then processing the material with a processing solution having a bleaching ability containing at least one bleaching agent; wherein said bleaching agent is a ferric complex of a compound represented by formula (II):

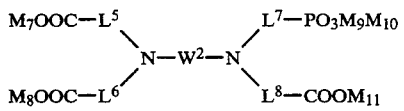

wherein $W^2$ represents an alkylene group having 2 to 8 carbon atoms, an arylene group having 6 to 10 carbon atoms, a cyclohexane group, $$\text{—}(W^{21}\text{—O})_m W^{22}\text{—},\quad \text{—}(W^{21}\text{—S})_m W^{22}\text{—},\quad \text{—}W^{21}\text{—}\underset{\underset{A}{|}}{N}\text{—}W^{22}\text{—}$$

in which $W^{21}$ and $W^{22}$ each represents an alkylene group, and m represents an integer of 1 to 3, and A represents a hydrogen atom, a hydrocarbon group, $\text{—}L_A\text{—COOM}$, $\text{—}L_A\text{—}PO_3M_2$, $\text{—}L_A\text{—OH}$, or $\text{—}L_A\text{—}SO_3M$, where $L_A$ represents an alkylene group having 1 to 8 carbon atoms or an arylene group having 6 to 10 carbon atoms, and M represents a hydrogen atom or a cation, or a combination thereof; $L^5$, $L^6$, $L^7$, and $L^8$ each represents an alkylene group; and $M_7$, $M_8$, $M_9$, $M_{10}$ and $M_{11}$ each represents a hydrogen atom or a cation;

wherein said ferric complex of the compound represented by formula (II) is present in an amount of 0.05 to 2.5 mol per liter of the processing solution.

2. A method of claimed in claim 1, wherein $L^5$, $L^6$, $L^7$ and $L^8$ each represents an alkylene group containing 1 to 6 carbon atoms.

3. A method as claimed in claim 1, wherein $L^5$, $L^6$, $L^7$ and $L^8$ each represents a methylene group or an ethylene group.

4. A method as claimed in claim 1, wherein $W^2$ represents $$\text{—}CH_2CH_2\text{—},\quad \text{—}CH_2CH_2CH_2\text{—},\quad \text{—}CH_2\overset{\overset{CH_3}{|}}{C}H\text{—},$$

$$\text{—}CH_2\overset{\overset{OH}{|}}{C}HCH_2\text{—},\quad \text{—}(CH_2)_4\text{—},$$

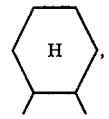

$$\text{—}CH_2CH_2\text{—}\overset{\overset{CH_2COOH}{|}}{N}\text{—}CH_2CH_2\text{—},\quad \text{—}CH_2CH_2OCH_2CH_2\text{—},$$

$$\text{—}CH_2CH_2SCH_2CH_2\text{—},$$

$$\text{—}CH_2CH_2\text{—}\underset{\underset{CH_2COOH}{|}}{N}\text{—}CH_2CH_2\underset{\underset{CH_2COOH}{|}}{N}CH_2CH_2\text{—}\quad \text{and}$$

$$\text{—}CH_2CH_2OCH_2CH_2OCH_2OCH_2CH_2\text{—}.$$

5. A method as claimed in claim 1, wherein said ferric complex of a compound represented by formula (II) is present in an amount of 0.05 to 1.5 mol per liter of the processing solution.

6. A method as claimed in claim 1, wherein said ferric complex of a compound represented by formula (II) is present in an amount of 0.1 to 0.8 mol per liter of the processing solution.

7. A method as claimed in claim 1, wherein said processing solution has a pH of 2 to 9.

8. A method as claimed in claim 1, wherein said composition is a bleaching solution containing an ammonium bromide as a rehalogenating agent in an amount of 0.1 to 5 mol per liter of the bleaching solution.

* * * * *